US012613037B1

(12) United States Patent
Lenz et al.

(10) Patent No.: US 12,613,037 B1
(45) Date of Patent: Apr. 28, 2026

(54) STABILIZER FOR PLURALITY OF MIXING TUBES OF MICROMIXER AND RELATED METHOD

(71) Applicant: GE Vernova Infrastructure Technology LLC, Greenville, SC (US)

(72) Inventors: Ellison August Lenz, Simpsonville, SC (US); Christopher D. Matthew, Simpsonville, SC (US); James Phillip Stanley, Jr., Liberty, SC (US)

(73) Assignee: GE Vernova Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 19/267,956

(22) Filed: Jul. 14, 2025

(51) Int. Cl.
*F23R 3/28* (2006.01)
*F23R 3/32* (2006.01)

(52) U.S. Cl.
CPC ..... *F23R 3/286* (2013.01); *F23R 3/32* (2013.01)

(58) Field of Classification Search
CPC ..... F23R 3/286; F23R 3/32
See application file for complete search history.

(56) References Cited

U.S. PATENT DOCUMENTS

| | | | | |
|---|---|---|---|---|
| 9,163,839 | B2 | 10/2015 | Westmoreland et al. | |
| 2012/0291440 | A1* | 11/2012 | Moehrle | F23R 3/60 60/737 |
| 2014/0083110 | A1* | 3/2014 | Stewart | F23R 3/286 60/737 |
| 2014/0338340 | A1* | 11/2014 | Melton | F23D 14/62 60/738 |
| 2016/0033133 | A1* | 2/2016 | Johnson | F23R 3/286 60/737 |

* cited by examiner

*Primary Examiner* — Andrew H Nguyen
(74) *Attorney, Agent, or Firm* — James Pemrick; Charlotte Wilson; Hoffman Warnick LLC

(57) ABSTRACT

A stabilizer for a plurality of mixing tubes of a micromixer includes a first member including a plurality of first openings defined therein. Each first opening receives a respective one of the plurality of mixing tubes. A second member includes a plurality of second openings defined therein. Each second opening receives a respective one of the plurality of mixing tubes. A tube engagement element is positioned between the first member and the second member and selectively engages an outer surface of the plurality of mixing tubes. A linear actuator selectively moves the second member and the first member together to engage the tube engagement therebetween with an outer surface of the plurality of mixing tubes to stabilize the plurality of mixing tubes. The tube engagement element may include an elastomeric member, or a collet positioned around each of the plurality of mixing tubes.

20 Claims, 18 Drawing Sheets

STABILIZER FOR PLURALITY OF MIXING TUBES OF MICROMIXER AND RELATED METHOD

TECHNICAL FIELD

The disclosure relates generally to combustors. More specifically, the disclosure relates to a stabilizer for a plurality of mixing tubes of a micromixer to, for example, prevent damage during a repair of the mixing tube(s), and a related method.

BACKGROUND

Combustors are used in a wide variety of applications to burn fuel with air. For example, gas turbine systems use combustors to generate power. In operation of a gas turbine system, air flows through a compressor and the compressed air is supplied to a combustion section. Specifically, the compressed air is supplied to a number of combustors each having a number of fuel nozzles, i.e., burners, which use the air in a combustion process with a fuel. The combustion section is in fluid communication with a turbine section in which the combustion gas flow's kinetic and thermal energy is converted to mechanical rotational energy.

The combustors in the combustion section can include a micromixer that includes a plurality of mixing tubes in which fuel and air are mixed. Each mixing tube is in fluid communication with air and fuel plenums at one end and in fluid communication with a combustion chamber of the combustor in which combustion occurs at an opposite end. Over time, the mixing tubes can become damaged, e.g., oxidized, so they do not work as efficiently as initially intended. New techniques to repair mixing tubes do not replace the entirety of a mixing tube, but only a tip portion thereof to reduce costs and prevent discarding large amounts of material (e.g., parts of the mixing tubes that are not damaged). Machining to remove the tip portions of the freestanding mixing tubes causes vibrations and deflections and may damage other portions of the mixing tubes. One current approach to address vibrations and deflections uses a removable vibration dampening material around a portion of the plurality of mixing tubes. For example, a portion of the plurality of mixing tubes may be encased in removable wax. However, the removable vibration dampening material presents a number of safety and environmental concerns.

BRIEF DESCRIPTION

All aspects, examples and features mentioned below can be combined in any technically possible way.

An aspect of the disclosure includes a stabilizer for a plurality of mixing tubes of a micromixer, the stabilizer comprising: a first member including a plurality of first openings defined therein, each first opening configured to receive a respective one of the plurality of mixing tubes; a second member including a plurality of second openings defined therein, each second opening configured to receive a respective one of the plurality of mixing tubes; a tube engagement element positioned between the first member and the second member and configured to selectively engage an outer surface of the plurality of mixing tubes; and a linear actuator configured to selectively move the second member and the first member together to engage the tube engagement therebetween with an outer surface of the plurality of mixing tubes to stabilize the plurality of mixing tubes.

Another aspect of the disclosure includes any of the preceding aspects, and the tube engagement element includes an elastomeric member including a plurality of third openings defined therein, each third opening configured to receive a respective one of the plurality of mixing tubes therein, wherein the linear actuator forces the second member and the first member together to compress the elastomeric member causing an inner surface of each third opening to engage with the outer surface of a respective mixing tube to stabilize the plurality of mixing tubes.

Another aspect of the disclosure includes any of the preceding aspects, and the first member includes a recess defined therein in which the elastomeric member is positioned, the recess configured to restrain lateral expansion of the elastomeric member as the linear actuator forces the second member and the first member together to compress the elastomeric member.

Another aspect of the disclosure includes any of the preceding aspects, and the second member has a projection configured to slidingly fit within the recess to compress the elastomeric member as the linear actuator forces the second member and the first member together.

Another aspect of the disclosure includes any of the preceding aspects, and the plurality of mixing tubes each include a shoulder step in an outer surface thereof, wherein the plurality of first openings in the first member are configured to axially engage the respective shoulder step.

Another aspect of the disclosure includes any of the preceding aspects, and the tube engagement element includes a collet positioned around each of the plurality of mixing tubes, wherein each collet includes at least one angled end configured to engage an angled inner portion of an opening in at least one of the first member and the second member.

Another aspect of the disclosure includes any of the preceding aspects, and each first opening in the first member includes an angled inner portion configured to engage with the angled second end of a respective collet to force the respective collet against the outer surface of a respective mixing tube as the linear actuator forces the second member, the respective collet and the first member together.

Another aspect of the disclosure includes any of the preceding aspects, and the plurality of mixing tubes each include a shoulder step in an outer surface thereof, wherein the plurality of first openings in the first member are configured to pass over a respective shoulder step and the plurality of second openings in the second member are configured to axially engage the respective shoulder step.

Another aspect of the disclosure includes any of the preceding aspects, and the linear actuator includes at least one threaded fastener, each threaded fastener configured to extend through and engage an outer surface of a fastener opening in one of the second member and the first member and threadedly couple into a mating threaded opening in the other one of the second member and the first member.

Another aspect of the disclosure includes a stabilizer for a plurality of mixing tubes of a micromixer, the stabilizer comprising: a first member including a plurality of first openings defined therein, each first opening configured to receive a respective one of the plurality of mixing tubes; a second member including a plurality of second openings defined therein, each second opening configured to receive a respective one of the plurality of mixing tubes; a tube engagement element positioned between the first member and the second member and configured to selectively engage an outer surface of at least one of the plurality of mixing tubes, wherein the tube engagement element includes one of: a) an elastomeric member including a plurality of third openings defined therein, each third opening configured to receive a respective one of the plurality of mixing tubes therein, or b) a collet positioned around each of the plurality of mixing tubes; and a linear actuator configured to selectively move the second member and the first member between an operative position in which the tube engagement element engages with an outer surface of the plurality of mixing tubes to stabilize the plurality of mixing tubes and an inoperative position in which the tube engagement element disengages with the outer surface of the plurality of mixing tubes.

Another aspect of the disclosure includes any of the preceding aspects, and where the tube engagement element includes the elastomeric member, the linear actuator forces the second member and the first member together to compress the elastomeric member causing an inner surface of each third opening to engage with the outer surface of a respective mixing tube to stabilize the plurality of mixing tubes.

Another aspect of the disclosure includes any of the preceding aspects, and the first member includes a recess defined therein in which the elastomeric member is positioned, the recess configured to restrain lateral expansion of the elastomeric member as the linear actuator forces the second member and the first member together to compress the elastomeric member.

Another aspect of the disclosure includes any of the preceding aspects, and the second member has a projection configured to slidingly fit within the recess to compress the elastomeric member as the linear actuator forces the second member and the first member together.

Another aspect of the disclosure includes any of the preceding aspects, and the plurality of mixing tubes each include a shoulder step in an outer surface thereof, wherein the plurality of first openings in the first member are configured to axially engage the respective shoulder step.

Another aspect of the disclosure includes any of the preceding aspects, and each collet includes a first end configured to engage one of the first member and the second member and an angled second end configured to engage the other of the first member and the second member, wherein the linear actuator forces the second member and the first member together to force an inner surface of each collet to engage with the outer surface of a respective mixing tube to stabilize the plurality of mixing tubes.

Another aspect of the disclosure includes any of the preceding aspects, and each first opening in the first member includes an angled inner portion configured to engage with the angled second end of a respective collet to force the respective collet against the outer surface of a respective mixing tube as the linear actuator forces the second member, the respective collet and the first member together.

Another aspect of the disclosure includes any of the preceding aspects, and the plurality of mixing tubes each include a shoulder step in an outer surface thereof, wherein the plurality of first openings in the first member are configured to pass over a respective shoulder step and the plurality of second openings in the second member are configured to axially engage the respective shoulder step.

Another aspect of the disclosure includes any of the preceding aspects, and the linear actuator includes at least one threaded fastener, each threaded fastener configured to extend through and engage an outer surface of a fastener opening in one of the second member and the first member and threadedly couple into a mating threaded opening in the other one of the second member and the first member.

Another aspect of the disclosure includes a method for stabilizing a plurality of mixing tubes of a micromixer, the method comprising: positioning a first member including a plurality of first openings defined therein over the plurality of mixing tubes; positioning a tube engagement element relative to the first member, the tube engagement element configured to selectively engage an outer surface of each of the plurality of mixing tubes; positioning a second member including a plurality of second openings defined therein over the plurality of mixing tubes; and moving the second member and the first member together to force the tube engagement therebetween to engage with an outer surface of the plurality of mixing tubes to stabilize the plurality of mixing tubes.

Another aspect of the disclosure includes any of the preceding aspects, and the tube engagement element includes one of: a) an elastomeric member including a plurality of third openings defined therein, each third opening configured to receive a respective one of the plurality of mixing tubes therein, or b) a collet positioned around each of the plurality of mixing tubes.

Two or more aspects described in this disclosure, including those described in this summary section, may be combined to form implementations not specifically described herein. That is, all embodiments described herein can be combined with each other.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
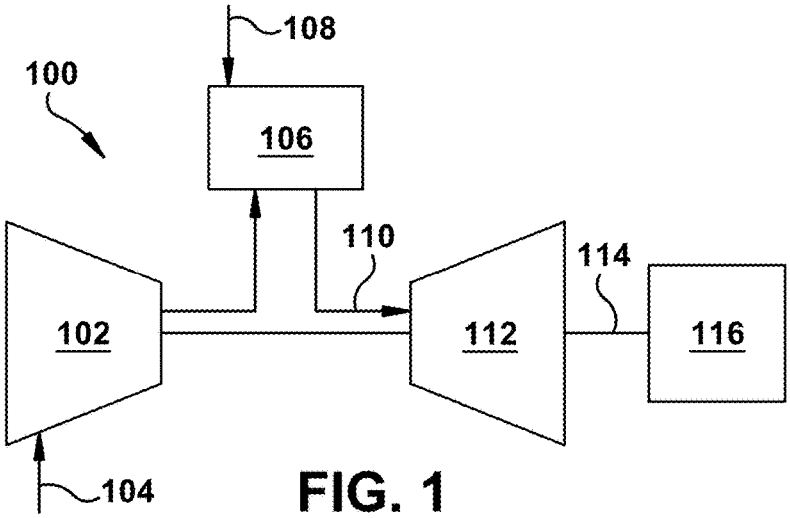
FIG. 1 (PRIOR ART)
FIG. 1 shows a schematic view of an illustrative gas turbine system that can employ a micromixer having mixing tubes stabilized using a stabilizer, according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current technology, it will become necessary to select certain terminology when referring to and describing relevant machine components within the illustrative application of micromixer for a combustor. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbomachine or, for example, the flow of air through the combustor or coolant through one of the turbomachine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the turbomachine, and "aft" referring to the rearward or turbine end of the turbomachine.

It is often required to describe parts that are at different radial positions with regard to a center axis. The term "axial" refers to movement or position parallel to an axis, e.g., an axis of a mixing tube. The term "radial" refers to movement or position perpendicular to an axis, e.g., an axis of a mixing tube. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. Finally, the term "circumferential" refers to movement or position around an axis, e.g., a circumferential exterior surface of a mixing tube. As indicated above, it will be appreciated that such terms may be applied in relation to the axis of the turbomachine.

In addition, several descriptive terms may be used regularly herein, as described below. The terms "first," "second," and "third," may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event may or may not occur or that the subsequently described feature may or may not be present and that the description includes instances where the event occurs or the feature is present and instances where the event does not occur or the feature is not present.

Where an element or layer is referred to as being "on," "engaged to," "connected to," "coupled to," or "mounted to" another element or layer, it may be directly on, engaged, connected, coupled, or mounted to the other element or layer, or intervening elements or layers may be present. In contrast, when an element is referred to as being "directly on," "directly engaged to," "directly connected to," or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The verb forms of "couple" and "mount" may be used interchangeably herein.

Embodiments of the disclosure provide a stabilizer for a plurality of mixing tubes of a micromixer. The stabilizer includes a first member including a plurality of first openings defined therein. Each first opening is configured to receive a respective one of the plurality of mixing tubes. A second member includes a plurality of second openings defined therein. Each second opening is also configured to receive a respective one of the plurality of mixing tubes. A tube engagement element is positioned between the first member and the second member and selectively engages an outer surface of the plurality of mixing tubes. A linear actuator is configured to selectively move the second member and the first member together to engage the tube engagement therebetween with an outer surface of the plurality of mixing tubes to stabilize the plurality of mixing tubes. The tube engagement element may include an elastomeric member, or a collet positioned around each of the plurality of mixing tubes. In operation, the stabilizer engages each mixing tube and holds them against vibration and/or deformation during, for example, a repair operation in which ends of damaged mixing tubes are removed and replaced. The stabilizer removes any safety and/or environmental concerns of using a removable vibration damping material, such as wax. A related method of use is also provided.

Illustrative embodiments are directed to, among other things, a stabilizer for a micromixer for a combustor for a gas turbine system. FIG. 1 shows a schematic view of an illustrative gas turbine (GT) system 100 that may employ combustor(s) using micromixer(s) that can be repaired using a stabilizer according to embodiments of the disclosure. As is known, GT system 100 may include a compressor 102 that compresses an incoming flow of air 104. Compressor 104 delivers the compressed flow of air 104 to a combustor 106. Combustor 106 mixes the compressed flow of air 104 with a pressurized flow of fuel 108 and ignites the mixture to create a flow of combustion gases 110. Although only a single combustor 106 is shown, GT system 100 may include any number of combustors 106. Flow of combustion gases 110 is in turn delivered to a turbine 112. Flow of combustion gases 110 drives turbine 112 to produce mechanical work. The mechanical work produced in turbine 112 drives compressor 102 via a shaft 114 and an external load 116 such as an electrical generator and the like.

GT system 100 may use natural gas, various types of syngas, and/or other types of fuels. GT system 100 may be, for example, any gas turbine engine offered by GE Vernova of Cambridge, MA, USA, including but not limited to a 7 or a 9 series heavy duty gas turbine engine and the like. Different configurations of GT system 100 may also benefit from the teachings of the disclosure. Other types of GT systems also benefit from the teachings herein.

Figure 2:
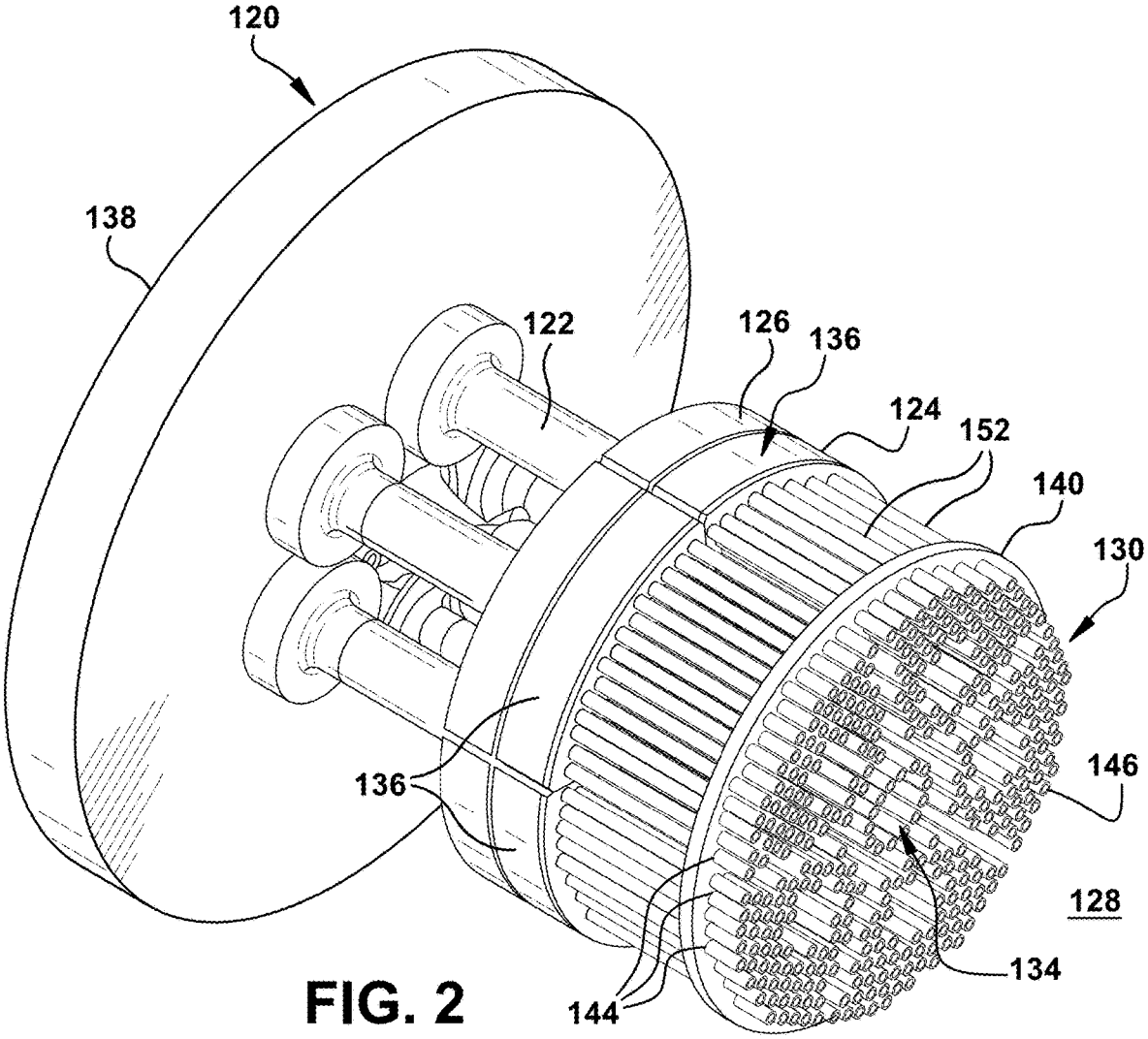
FIG. 2 shows a perspective view of a micromixer having mixing tubes that can be stabilized using a stabilizer, according to according to embodiments of the disclosure.
Figure 3A:
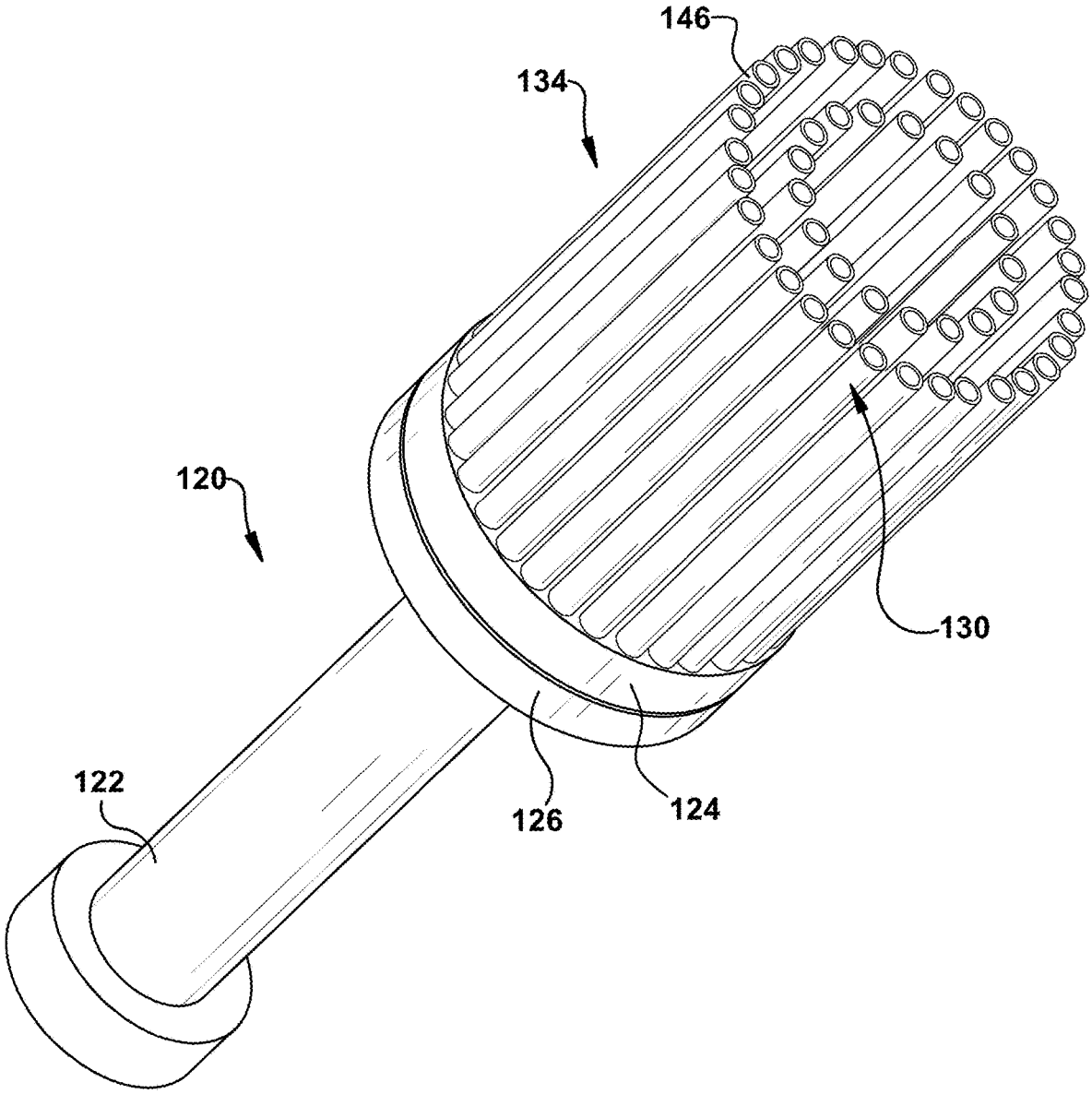
FIG. 3A shows a perspective view of a center fuel nozzle of a micromixer including a plurality of mixing tubes that can be stabilized using a stabilizer, according to embodiments of the disclosure.
Figure 3B:
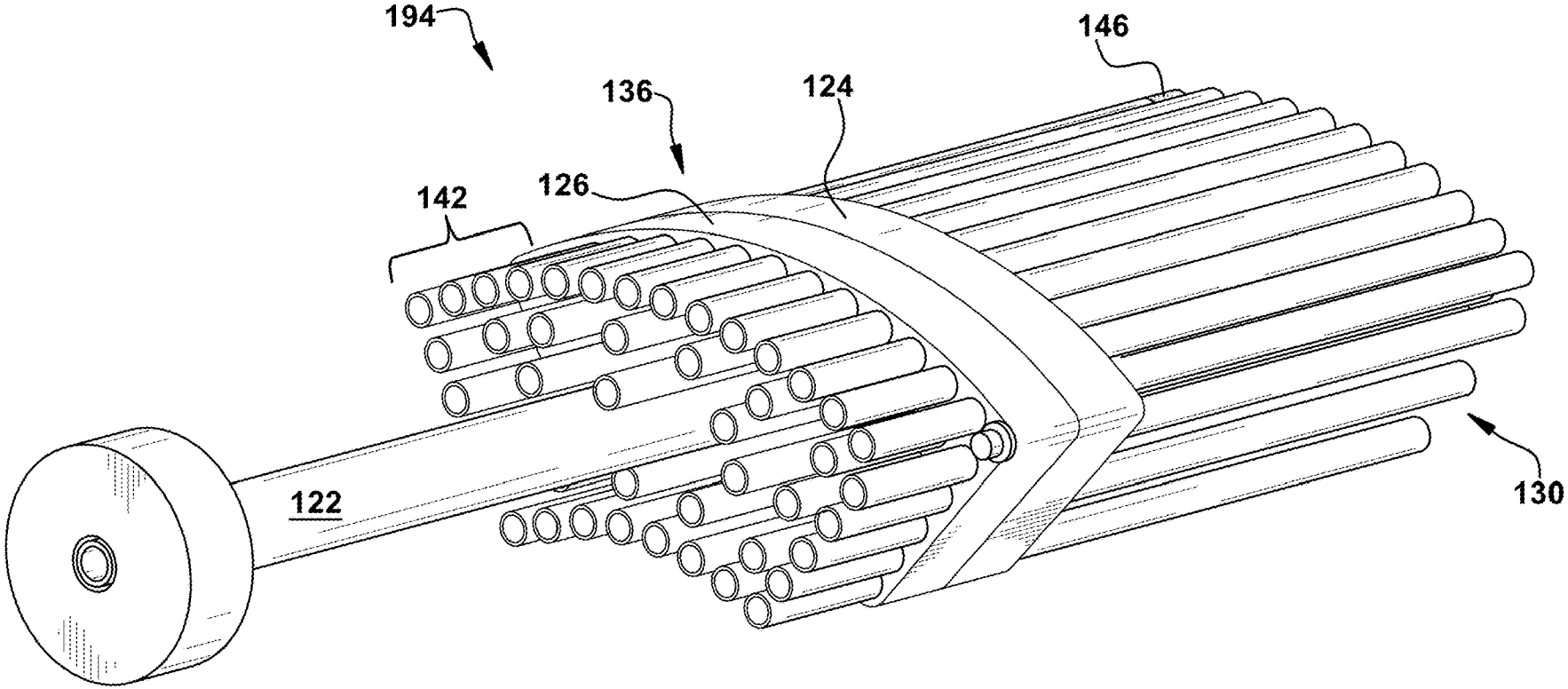
FIG. 3B shows a perspective view of an outer fuel nozzle of a micromixer including a plurality of mixing tubes that can be stabilized using a stabilizer, according to embodiments of the disclosure.

FIGS. 2 and 3A-B depict a component of combustor(s) 106 in FIG. 1; specifically, a micromixer 120 or a portion thereof. Micromixer 120 is part of combustor(s) 106. Micromixer 120 may include a base nozzle structure 122, a fuel plenum 124 and an air plenum 126. Micromixer 120 also includes a plurality of mixing tubes 130 in fluid communication with fuel plenum 124, air plenum 126 and a combustion chamber 128 of combustor 106. Related operative structure to fuel plenum 124, air plenum 126 and mixing tubes 130 will now be described. It is emphasized that related structure is merely illustrative and micromixer 120 may include a variety of different arrangements of related operative structure, all of which are considered within the scope of the disclosure.

Continuing with the description, micromixer 120 may include base nozzle structure 122 in communication with fuel plenum 124, air plenum 126, and plurality of mixing tubes 130 forming one or more segmented mixing tube bundles or fuel nozzle segments 134, 136 (FIGS. 3A-B). Base nozzle structure 122 supplies a fuel to fuel plenum 124. The fuel exits fuel plenum 124 and enters plurality of mixing tubes 130. Air is directed into mixing tubes 130 through air plenum 126 and mixes with the fuel to create a fuel-air mixture. The fuel-air mixture exits mixing tubes 130 and enters into a downstream combustion chamber 128, where it is combusted in a known fashion for use in turbine 112 (FIG. 1).

Still referring to FIGS. 2 and 3A-B, micromixer 120 may be segmented, meaning the micromixer 120 may include a number of bundles of mixing tubes 130, referenced herein as fuel nozzle segments 134, 136, supported by base nozzle structure 122. That is, in the segmented micromixer 120, each fuel nozzle segment 134, 136 includes a bundle of mixing tubes 130. Each bundle of mixing tubes 130 are at least partially supported by base nozzle structure 122. Base nozzle structures 122 may be attached to a combustion end cover 138 (FIG. 2). While a particular upstream structure of micromixer 120 and fuel nozzle segments 134, 136 has been provided, it is emphasized that micromixers 120 can have a variety of different arrangements upstream from mixing tubes 130 to provide air and fuel to mixing tubes 130 and the teachings of the disclosure are not limited to the previously described illustrative arrangement.

FIGS. 3A and 3B are perspective views of bundles of mixing tubes 130 separated from micromixer 120 (FIG. 2), i.e., as fuel nozzle segments 134, 136. FIG. 3A shows a center fuel nozzle segment 134 separated from micromixer 120 (FIG. 2), and FIG. 3B shows one outer fuel nozzle segment 136 separated from micromixer 120 (FIG. 2). In FIG. 2, center fuel nozzle segment 134, i.e., bundle of mixing tubes 130 with respective base nozzle structure 122, is surrounded by a plurality (in this case, perhaps five) outer fuel nozzle segments 136, i.e., bundles of mixing tubes 130 with respective base nozzle structure 122. Each outer fuel nozzle segment 136 has a truncated wedge shape, such that outer fuel nozzle segments 136 may be positioned in close proximity to center fuel nozzle segment 134 and cover a majority of the head end area. Each fuel nozzle segment 134, 136 includes a plurality of mixing tubes 130 that are part of each respective fuel nozzle segment 134, 136 and may extend through, as shown in FIG. 2, an end cap assembly (plate) 140. In one non-limiting example, center fuel nozzle segment 134 may have approximately 60 mixing tubes 130, and each outer fuel nozzle segment 136 may have approximately 80 mixing tubes 130. That stated, it should be noted that the specific size, spacing, and number of mixing tubes 130 shown in FIGS. 2-3B is intended to be representative, and fuel nozzle segments 134, 136 should not be construed as limiting the disclosure in terms of mixing tube size, spacing, or number other than described herein.

In some embodiments, as shown in FIG. 3B, one or more outer fuel nozzle segments 136 may be provided with a tube extension bundle 142 removably mounted to the upstream (inlet) end of outer fuel nozzle segment 136 to mitigate dynamics. Tube extension bundle 142 includes a mounting plate and a plurality of tube extensions that are aligned with a majority of mixing tubes 130 in outer fuel nozzle segments 136 (e.g., those mixing tubes 130 radially outward of base nozzle structure 122). Tube extension bundle 142 may not be present in all outer fuel nozzle segments 136 or even in every implementation of micromixer 120 and, thus, may be described herein as being an optional feature.

In an operative position, micromixer 120 may include end cap assembly 140 disposed about each of the segmented mixing tube 130 bundles. End cap assembly 140 may include a cap face (not labeled) having a number of apertures 144 for corresponding segmented mixing tube 130 bundles to pass through. End cap assembly 140 may provide additional support to the segmented mixing tube 130 bundles. In certain embodiments, end cap assembly 140 may be removable from the segmented mixing tube 130 bundles such that during maintenance, end cap assembly 140 may be removed and segmented mixing tube 130 bundles may be repaired, and end cap assembly 140 put back on. In other embodiments, end cap assembly 140 may be removably attached to some other support structure (not shown) encompassing micromixer 120.

As noted, micromixer 120 includes plurality of mixing tubes 130 that may require periodic repair, e.g., to remove oxidization or other damage. For example, one or more of plurality of mixing tubes 130 may be repaired by replacing a tip 146 (FIGS. 3A-B) thereof. Tip 146 may be removed by machining that can cause vibration and/or deformation to the mixing tube 130 being worked on or adjacent mixing tubes 130. In order to reduce vibration and/or deformation of mixing tubes 130, embodiments of the disclosure include a stabilizer 150 (FIGS. 4A-7B, 9A-B and 11C) for plurality of mixing tubes 130 of micromixer 120.

Figure 4A:
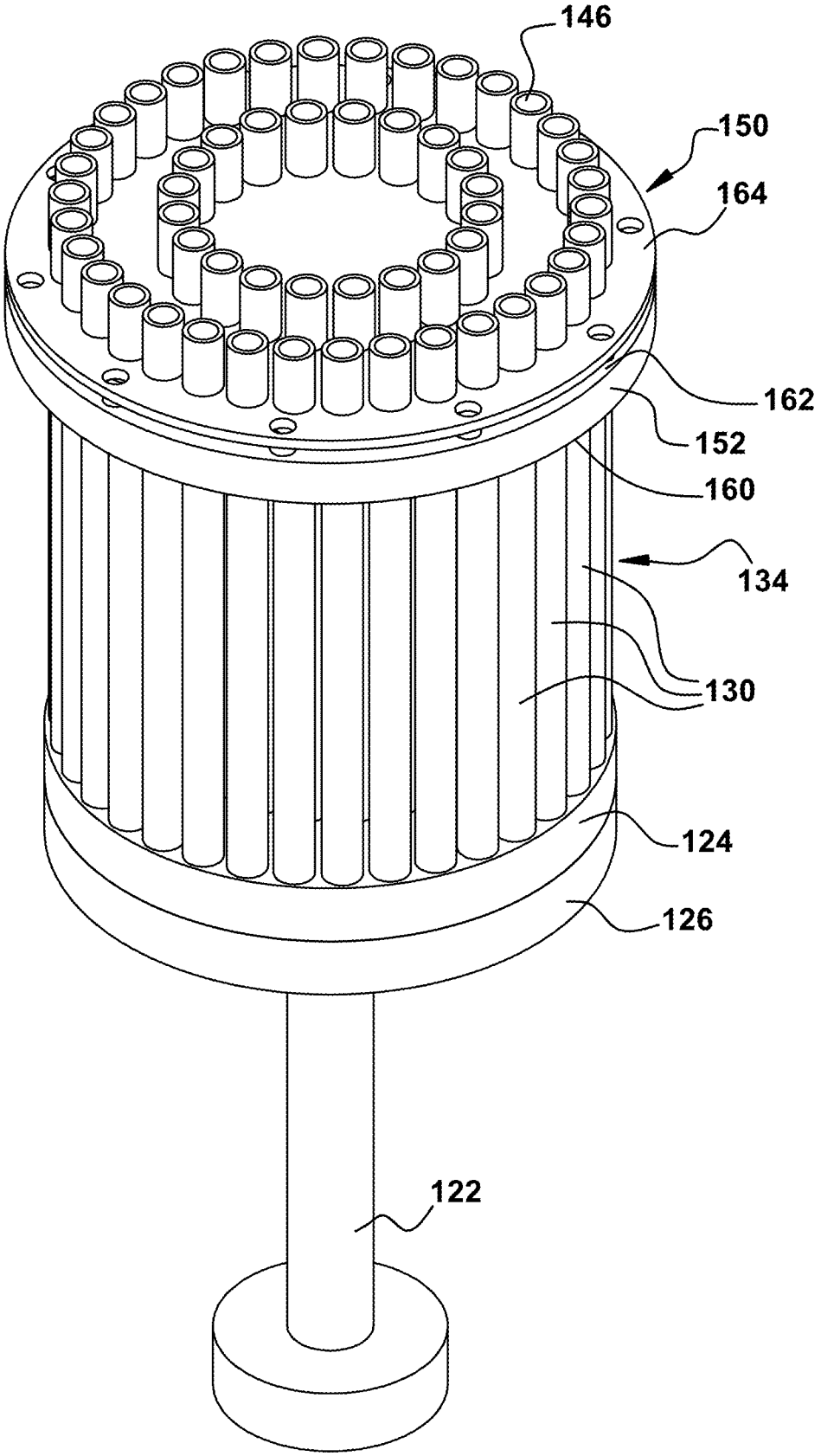
FIG. 4A shows a perspective view of a center fuel nozzle segment including a plurality of mixing tubes that can be stabilized using a stabilizer, according to embodiments of the disclosure.
Figure 4B:
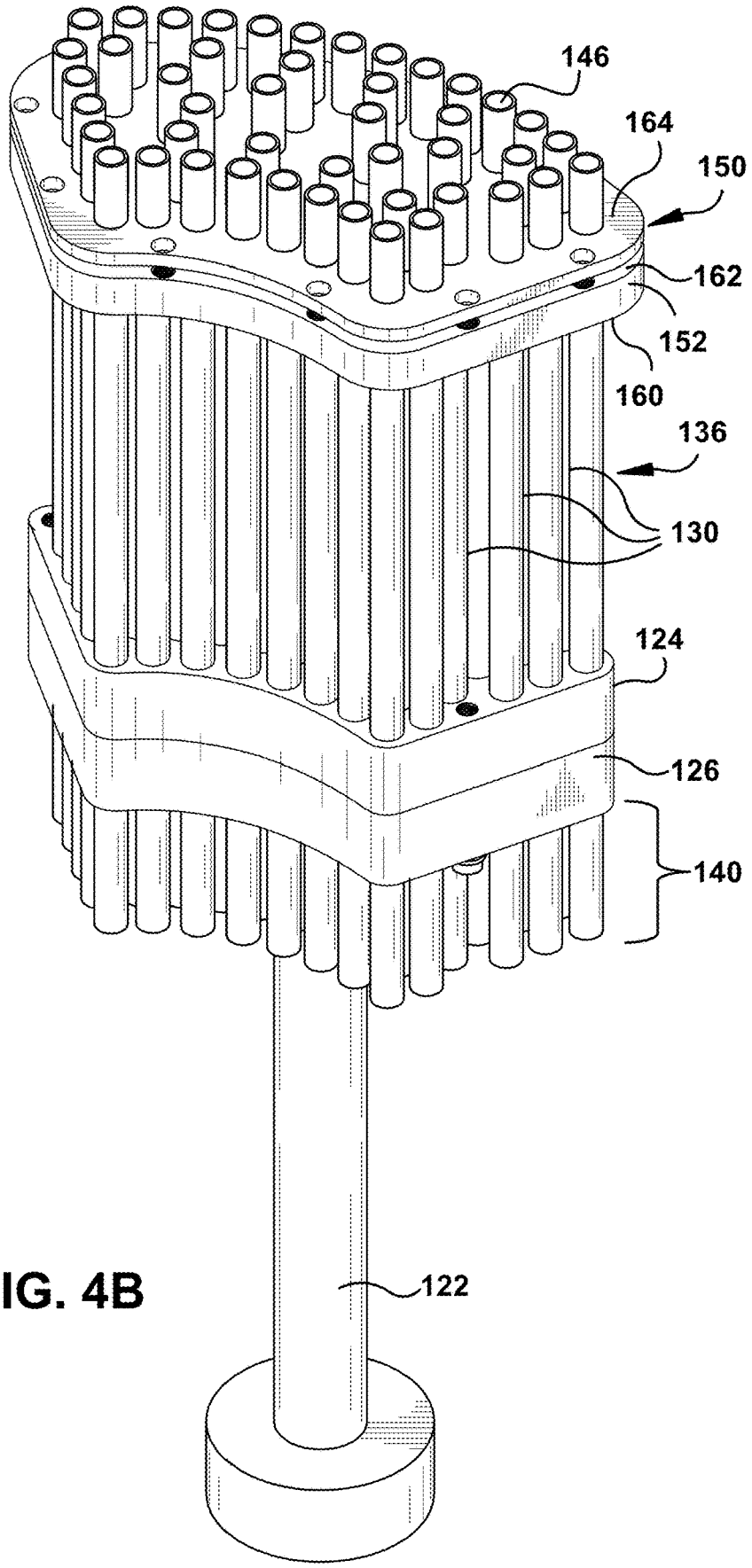
FIG. 4B shows a perspective view of an outer fuel nozzle segment including a plurality of mixing tubes that can be stabilized using a stabilizer, according to embodiments of the disclosure.

FIG. 4A shows a perspective view of stabilizer 150 on a center fuel nozzle segment 134 and FIG. 4B shows a perspective view of stabilizer 150 on an outer fuel nozzle segment 136. For purposes of description, stabilizer 150 will be described as shaped to operate with outer fuel nozzle segment 136. It is recognized that the teachings of the disclosure are equally applicable to stabilizer 150 having different shapes to accommodate different shaped fuel nozzle segments, such as center fuel nozzle segment 134 (FIG. 4A).

Figure 5:
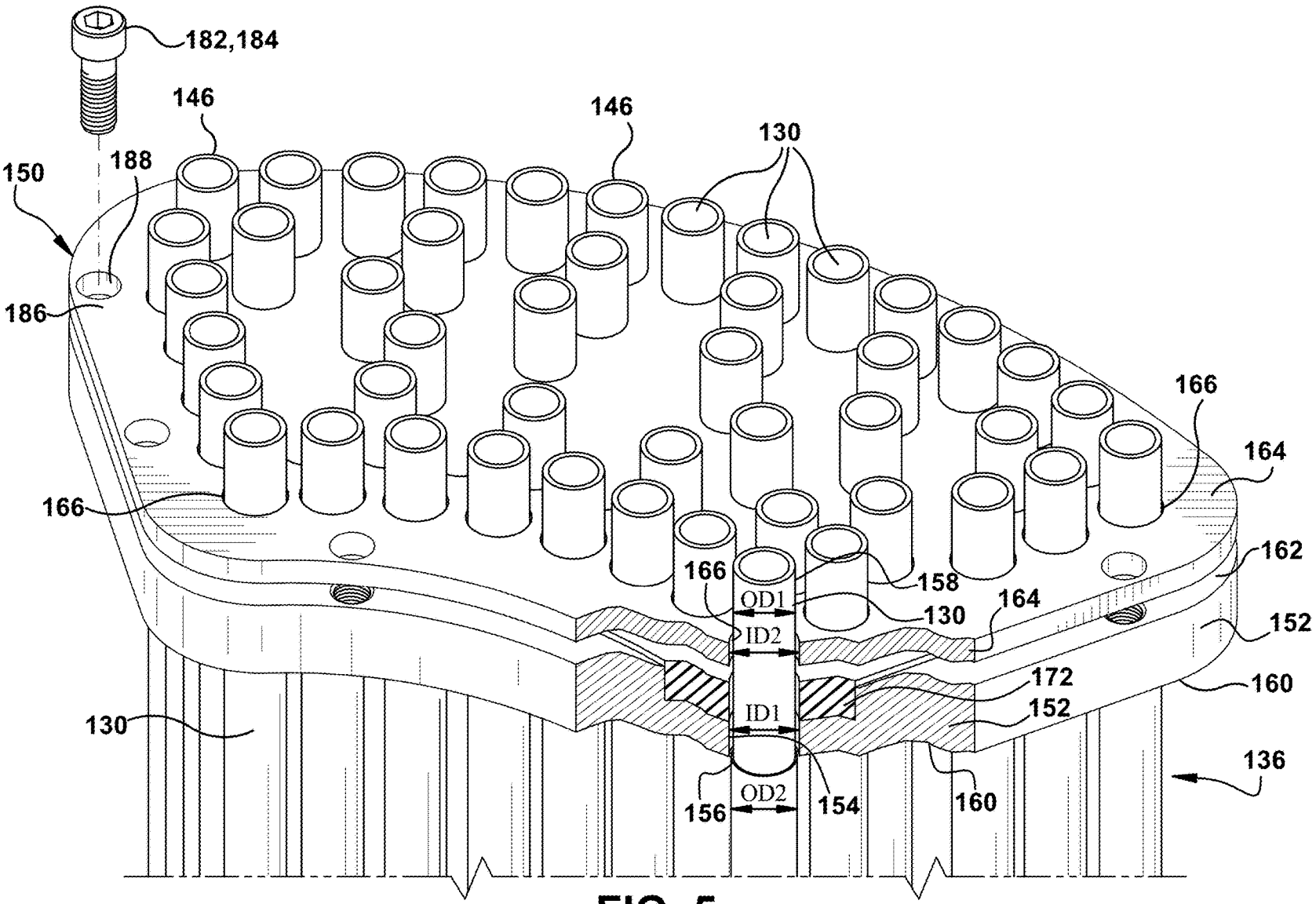
FIG. 5 shows an enlarged perspective view, with partial cross-section, of a stabilizer on an outer fuel nozzle segment including a plurality of mixing tubes, according to embodiments of the disclosure.
Figure 6:
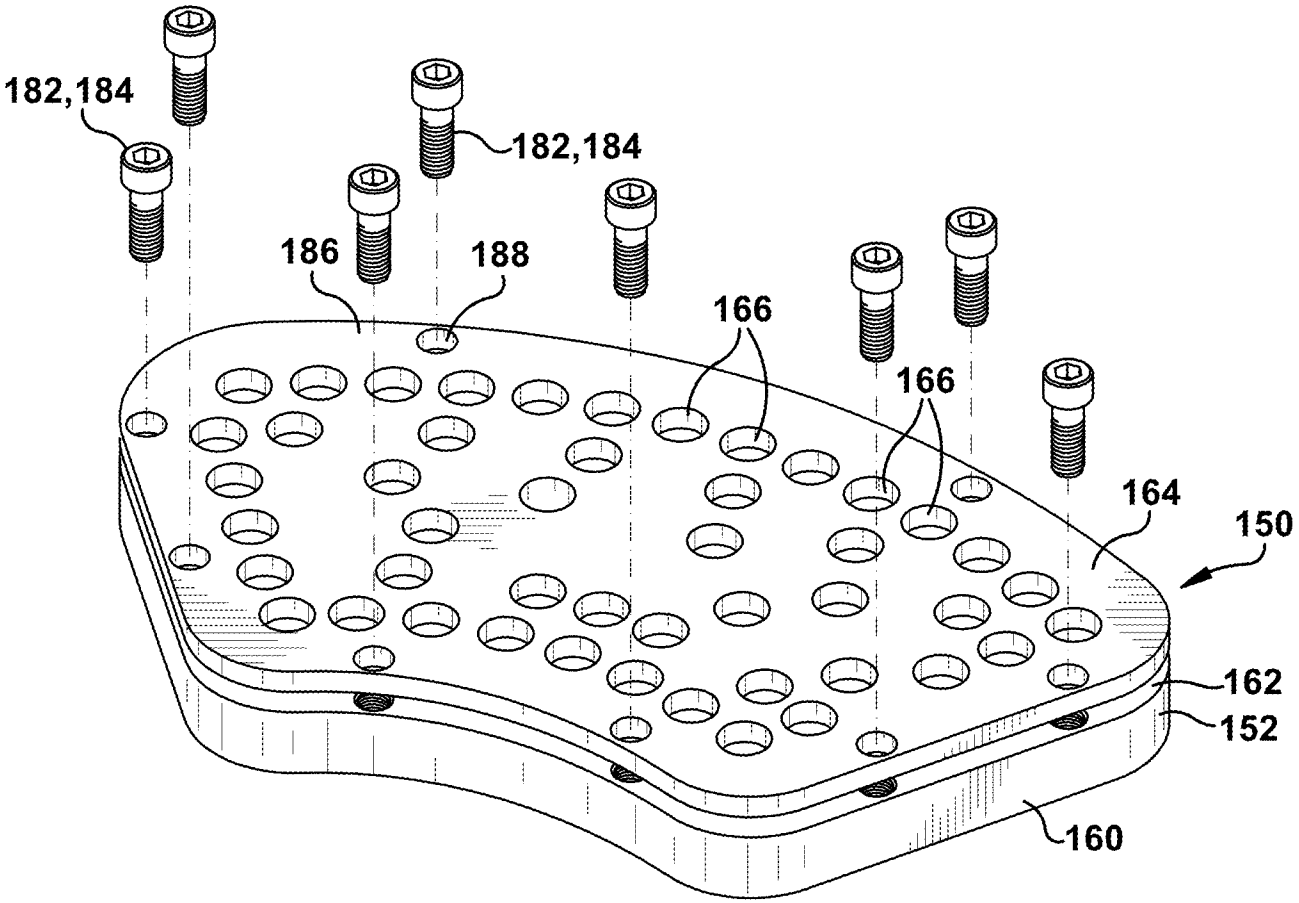
FIG. 6 shows a perspective view of a stabilizer apart from a fuel nozzle segment, according to embodiments of the disclosure.
Figure 7A:
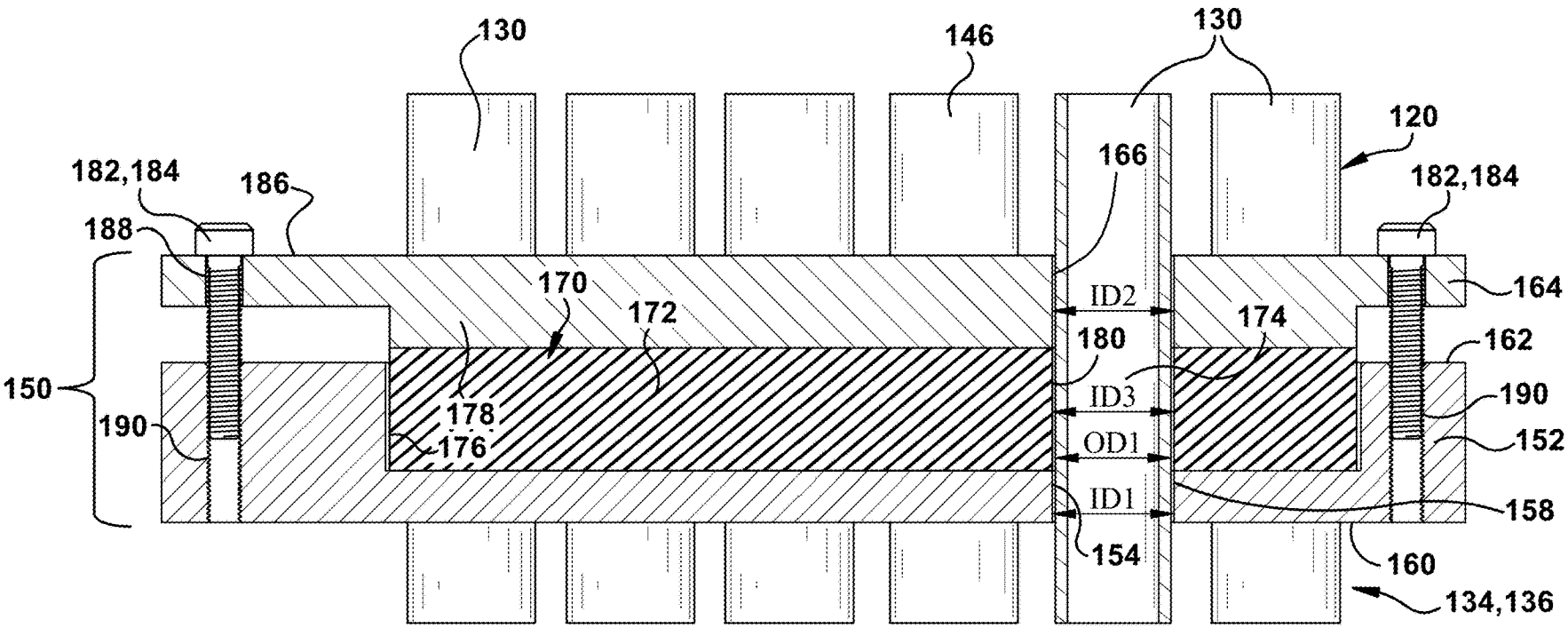
FIG. 7A shows a cross-sectional view of a stabilizer in an inoperative position and FIG. 7B shows a cross-sectional view of a stabilizer in an operative position, according to embodiments of the disclosure.
Figure 7B:
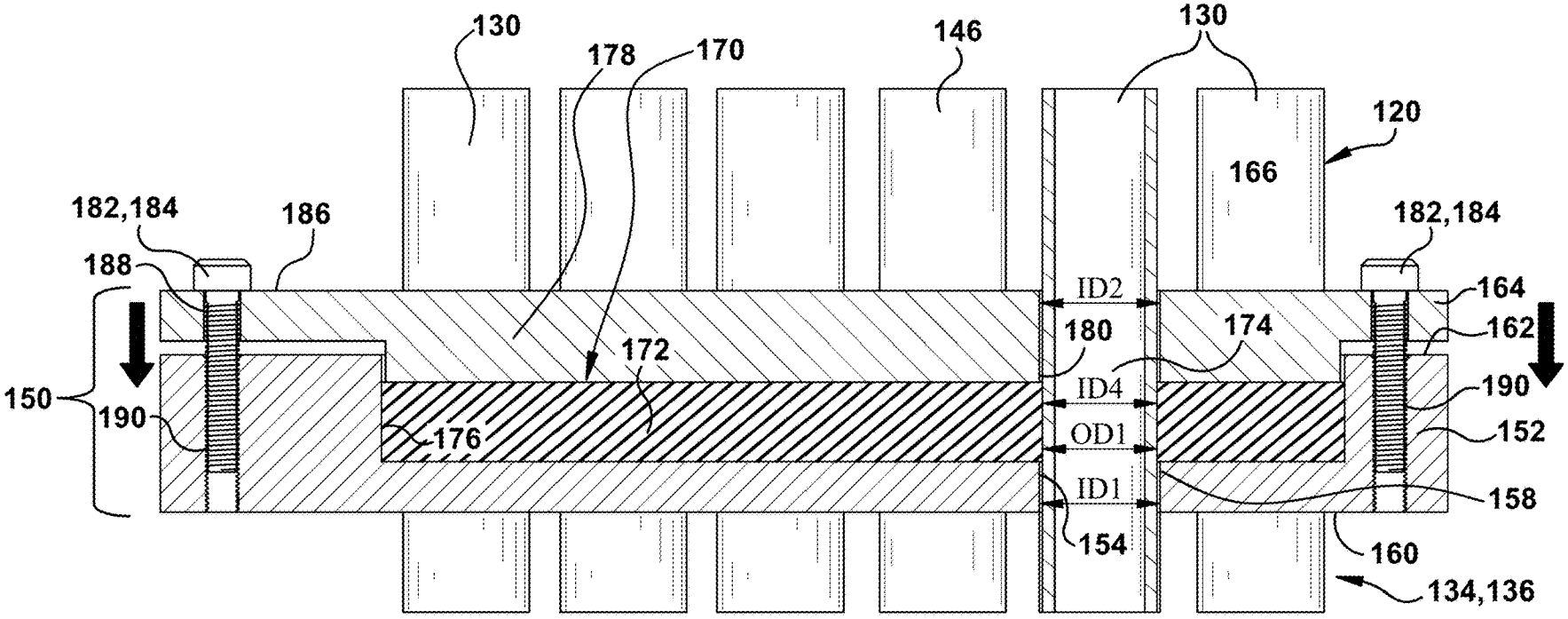

FIG. 5 shows an enlarged perspective view of stabilizer 150 on an outer fuel nozzle segment 136 including a plurality of mixing tubes 130; and FIG. 6 shows a perspective view of stabilizer 150 apart from a fuel nozzle segment, according to embodiments of the disclosure. FIG. 7A shows a cross-sectional view of stabilizer 150 in an inoperative position on plurality of mixing tubes 130, and FIG. 7B shows a cross-sectional view of stabilizer 150 in an operative position on plurality of mixing tubes, according to embodiments of the disclosure.

As shown in FIGS. 4A-7B, stabilizer 150 includes a first member 152 including a plurality of first openings 154 (FIGS. 7A-B) defined therein. Each first opening 154 is configured to receive a respective one of plurality of mixing tubes 130 (hereafter "mixing tubes 130"). More particularly, each first opening 154 has an inner diameter ID1 sized slightly larger than an outer diameter OD1 of mixing tubes 130. In one non-limiting example, mixing tubes 130 may have outer diameter OD1 of approximately 0.635-1.778 centimeters (cm) (~0.0.250-0.700 inches (in.)) and first openings 154 may have an inner diameter ID1 of approximately 0.686-1.905 cm (~0.270-0.750 in). Other diameters are also possible.

Regardless of relative diameters, as shown in FIG. 7A, first openings 154 allow mixing tubes 130 to move axially therethrough so first member 152 can pass thereover. That is, so each mixing tube 130 is received in a respective first opening 154. In certain embodiments, as shown in the cross-sectional portion of FIG. 5, mixing tubes 130 may each include a shoulder step 156 on an outer surface 158 thereof. Shoulder step 156 is optional and may not be present in all instances of mixing tubes 130. Where shoulder step 156 is provided, shoulder step 156 may have an outer diameter OD2 slightly larger than inner diameter ID1 of first openings 154, e.g., approximately 0.1 cm (~0.04 in.). In this configuration, an axial surface 160 of first member 152 adjacent first openings 154 are configured to axially engage respective shoulder steps 156. (Note, axial surface 160 of first member 152 is that axial surface closer to base nozzle structure 122 (FIGS. 4A-B), and axial surface 162 of first member 152 is closer to tips 146 of mixing tubes 130). More particularly, shoulder steps 156 in mixing tubes 130 engage with axial surface 160 of first member 152 adjacent first openings 154 to axially position first member 152 along mixing tubes 130, i.e., at shoulder steps 156. Shoulder steps 156 may be positioned at any desired axial position on mixing tubes 130, e.g., to ensure tube engagement element of stabilizer 150, described herein, has a consistent outer diameter OD1 on mixing tubes 130 to engage for stabilization thereof. It is noted, however, shoulder steps 156 may not be necessary in all cases, and may be omitted. For example, mixing tubes 130 in FIGS. 7A-B do not have shoulder steps.

Stabilizer 150 also includes a second member 164 including a plurality of second openings 166 defined therein. Each second opening 166 is configured to receive a respective one of the plurality of mixing tubes 130. That is, so each mixing tube 130 is received in a respective second opening 166. More particularly, each second opening 166 has an inner diameter ID2 sized slightly larger than outer diameter OD1 of mixing tubes 130. In one non-limiting example, mixing tubes 130 may have outer diameter OD1 of approximately 0.635-1.778 centimeters (cm) (~0.0.250-0.700 inches (in.)) and first openings 154 may have an inner diameter ID1 of approximately 0.686-1.905 cm (~0.270-0.750 in). However, inner diameter ID2 of second openings 166 does not have to be the same as inner diameter ID1 of first openings 154 in first member 152. Other diameters are also possible. Regardless of relative diameters, as shown in FIG. 7A, second openings 166 allow mixing tubes 130 to move axially therethrough so second member 164 can pass thereover.

Figure 8:
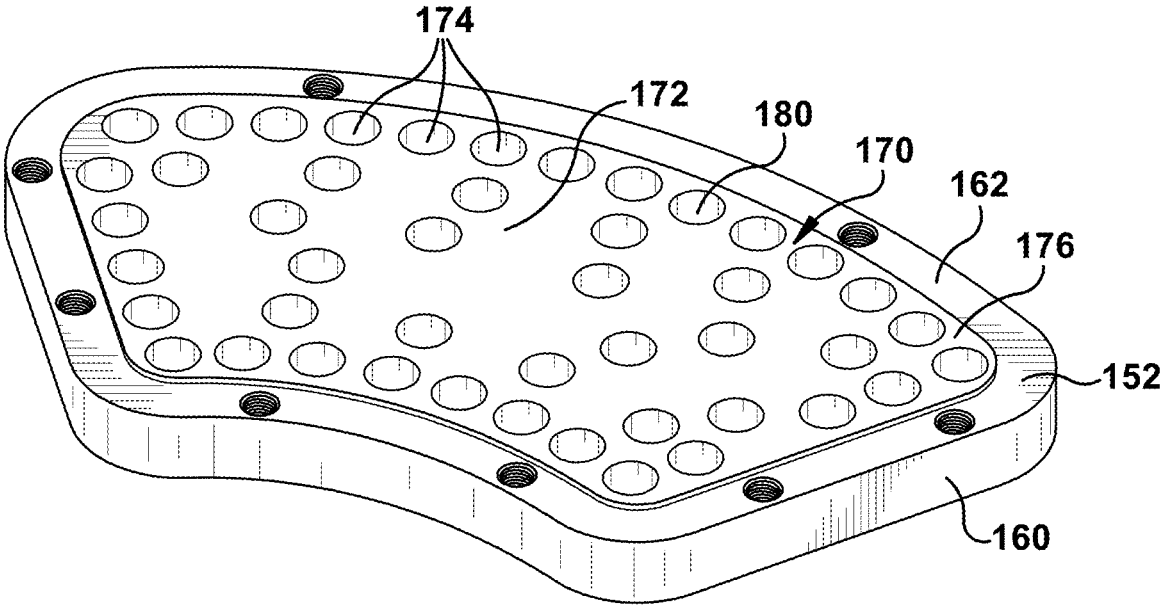
FIG. 8 shows a perspective view of a first member and a tube engagement element of a stabilizer, according to embodiments of the disclosure.

First member 152 and second member 164 may be made out of any metal, metal alloy or hard plastic having sufficient strength to withstand the forces applied thereto, as described herein. FIG. 8 shows a perspective view of first member 152 of stabilizer 150, according to embodiments of the disclosure. As shown in FIGS. 7A-B and 8, stabilizer 150 also includes a tube engagement element 170 positioned between first member 152 and second member 164. As will be described herein, in an operative position of stabilizer 150, as shown in FIG. 7B, tube engagement element 170 is configured to selectively engage outer surface 158 of mixing tubes 130. In contrast, in an inoperative position, as shown in FIG. 7A, tube engagement element 170 is disengaged from outer surface 158 of mixing tubes 130 and can slide thereover.

Tube engagement element 170 can take a variety of forms. For example, as will be described herein, tube engagement element 170 can include an elastomeric member including a plurality of third openings defined therein, or a collet positioned around each mixing tube 130.

In the FIGS. 7A-B and 8 embodiment, tube engagement element 170 may include an elastomeric member 172 including a plurality of third openings 174 defined therein. In most cases, each mixing tube 130 may have a respective third opening 174; however, that may not be necessary in all cases, e.g., where less than all mixing tubes 130 on a given fuel nozzle segment 134, 136 require stabilization. In the inoperative position, as shown in FIG. 7A, each third opening 174 is configured to receive a respective one of mixing tubes 130 therein. In this position, tube engagement element 170 is disengaged with outer surface 158 of mixing tubes 130. More particularly, in the inoperative position, each third opening 174 may have an inner diameter ID3 sized slightly larger than outer diameter OD1 of mixing tubes 130. As noted, in one non-limiting example, mixing tubes 130 may have outer diameter OD1 of approximately 0.635-1.778 centimeters (cm) (~0.0.250-0.700 inches (in.)) and first openings 154 may have an inner diameter ID1 of approximately 0.686-1.905 cm (~0.270-0.750 in). However, inner diameter ID3 of third openings 174 does not have to be the same as inner diameter ID1 of first openings 154 in first member 152 or inner diameter ID2 of second openings 166 in second member 164. Other diameters are also possible. Regardless of relative diameters, as shown in FIG. 7A, third openings 174 allow mixing tubes 130 to move axially therethrough in the inoperative position of stabilizer 150, so tube engagement element 170 slides over mixing tubes 130.

Elastomeric member 172 may include any now known or later developed natural or synthetic polymer having elastic properties. Elastomeric member 172 should be elastically deformable under pressure/force from first member 152 and second member 164 and returnable to its original shape once the force is removed. Elastomeric member 172 should also be resilient so it can be used repeatedly. Elastomeric member 172 has height (vertical on page) configured such tha it is compressed by first member 152 and second member 164 when they are brought together to an operative position as in FIG. 8. Where tube engagement element 170 includes elastomeric member 172, as shown in FIGS. 7A-B and 8, first member 152 may include a recess 176 defined therein in which elastomeric member 172 is positioned. As will be described, recess 176 restrains lateral expansion of elastomeric member 172 as a linear actuator 182 forces second member 164 and first member 152 together to compress elastomeric member 172. Elastomeric member 172 may extend out beyond axial surface 162 of first member 152, but this may not be necessary in all cases. For example, as shown in FIGS. 7A-B, second member 164 may optionally include a projection 178 configured to slidingly fit within recess 176 to compress elastomeric member 172 as linear actuator 182 forces second member 164 and first member 152 together. Projection 178 can have any horizontal shape and vertical depth relative to the rest of second member 164 configured to fit within recess 176 in a manner to compress elastomeric member 172. For example, it may have the same shape as recess 176 (and elastomeric member 172), or it can have a different shape. Where elastomeric member 172 extends beyond axial surface 162 of first member 152, as shown in FIG. 5, it may be possible to omit projection 178.

Referring to FIGS. 6 and 7A-B, stabilizer 150 also includes a linear actuator 182 configured to selectively move second member 164 and first member 152 together to engage tube engagement element 170 with outer surface 158 of mixing tubes 130 to stabilize mixing tubes 130. More particularly, linear actuator 182 is configured to selectively move second member 164 and first member 152 between an operative position, as shown in FIG. 7B, in which tube engagement element 170 is compressed and forced to engage with outer surface 158 of mixing tubes 130 to stabilize mixing tubes 130 and the inoperative position, shown in FIG. 7A, in which, as noted, tube engagement element 170 is disengaged with outer surface 158 of mixing tubes 130.

In the inoperative position, as shown in FIG. 7A, first member 152 and second member 164 are sufficiently separated so that they do not compress tube engagement element 170, i.e., elastomeric member 172 is in a generally undeformed state. In this position, tube engagement element 170 is disengaged from outer surfaces 158 of mixing tubes 130 and can slide over mixing tubes 130. Accordingly, in the inoperative position, stabilizer 150 including first member 152, second member 164 and tube engagement element 170 can be installed and/or uninstalled from mixing tubes 130 of a particular fuel nozzle segment 134, 136. Where shoulder steps 156 are provided, as shown in FIG. 5, they position first member 152 at that axial location of mixing tubes 130 during installation of stabilizer 150. Where shoulder steps 156 are not provided, first member 152 can be positioned in any desired axial location of mixing tubes 130 and may be held in that axial location, as will be described herein, when stabilizer 150 is in operative position.

In the operative position, as shown in FIG. 7B, linear actuator 182 moves first member 152 and second member 164 closer together (than in the inoperative position in FIG. 7A). As linear actuator 182 forces second member 164 and first member 152 together, they compress elastomeric member 172 causing an inner surface 180 of each third opening 174 to engage with outer surface 158 of a respective mixing tube 130 to stabilize mixing tubes 130. More particularly, first member 152 and second member 164 compress elastomeric member 172, which reduces inner diameter of second openings 166 from ID3 to ID4, i.e., ID4 (FIG. 7A)<ID3 (FIG. 7B). Elastomeric member 172 sits in (mating) recess 176 in first member 152. Recess 176 extends along sidewall of elastomeric member 172 and restrains lateral expansion of elastomeric member 172 outside of first member 152 to ensure the desired radially inward deformation occurs at third openings 174 to engage mixing tubes 130. In the operative position, each third opening 174 may have an inner diameter ID4 sized to engage outer surface 158, i.e., outer diameter OD1, of mixing tubes 130. That is, each third opening 174 grasps or grips a respective mixing tube 130. Here, an outer diameter OD1 of mixing tubes 130 and inner diameter ID4 of third openings 174 in elastomeric member 172, in the operative position, are the same or nearly the same. Note, elastomeric member 172 does not have an inner diameter ID4 of third openings 174 in the operative position small enough to damage mixing tubes 130. Rather, in the operative position, elastomeric member 172 holds mixing tubes 130 against vibration and/or deformation, stabilizing mixing tubes 130. Once repairs are complete on fuel nozzle segments 134, 136 and/or mixing tubes 130, linear actuator 182 can be released to place stabilizer 150 in the inoperative position so it can be removed from mixing tubes 130.

Linear actuator 182 can take a variety of forms. In the example shown in FIGS. 6 and 7A-B, linear actuator 182 includes at least one threaded fastener 184. Each threaded fastener 184 extends through and engages an outer surface 186 of a fastener opening 188 in one of second member 164 and first member 152 (second member 164 as shown) and threadedly couples into a mating threaded opening 190 in the other one of second member 164 and first member 152 (first member 152 as shown). Threaded fasteners 184 may be actuated using any known or later developed mechanism, e.g., manually using a radial handle or a powered wrench or ratchet coupled thereto. It will be recognized that linear actuator 182 can take a wide variety of alternative forms such as but not limited to hydraulic, pneumatic or electric rams; camlocks; C-clamps (see FIGS. 9A-B); worm gear systems and/or combinations thereof.

Figure 9A:
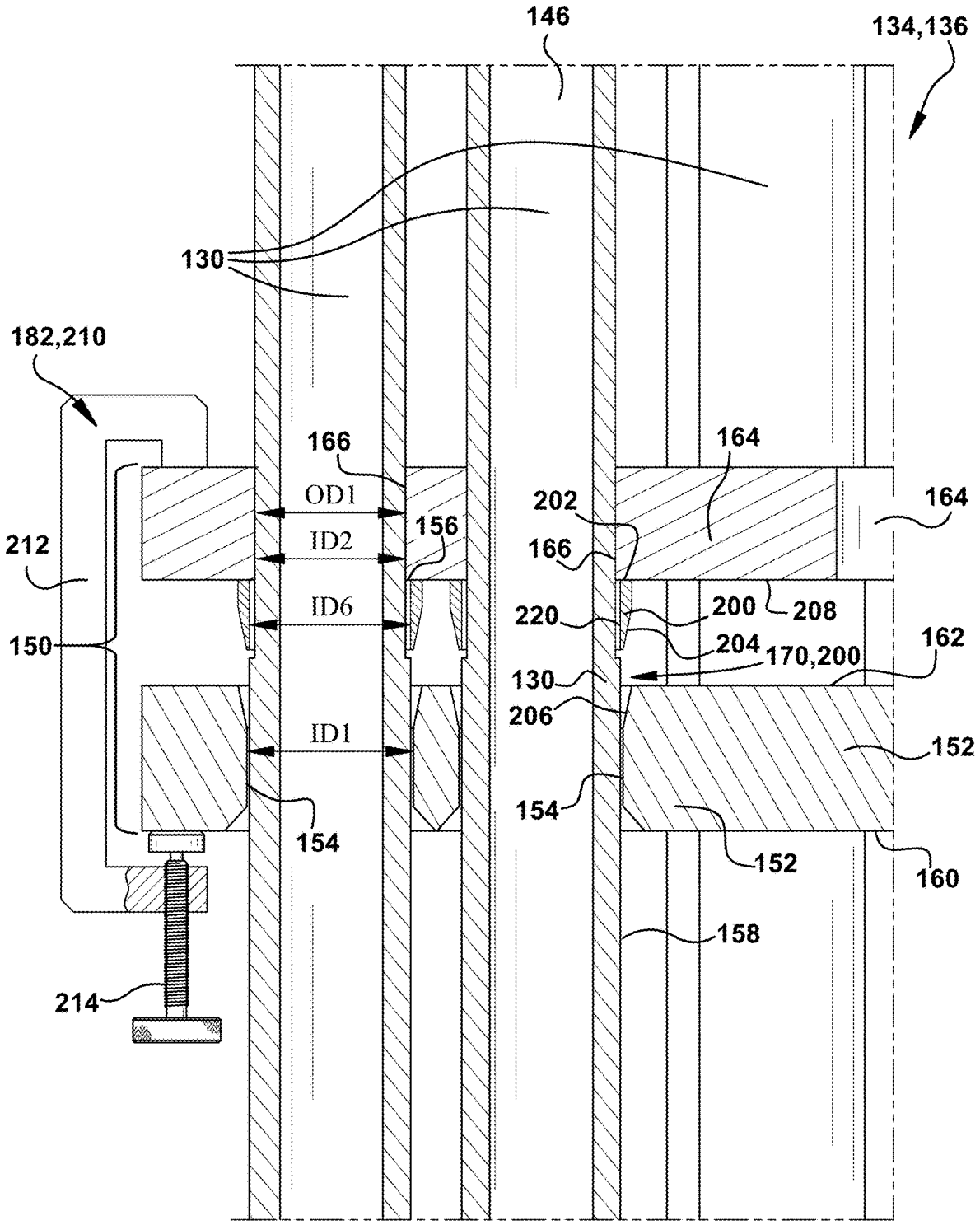
FIG. 9A shows a cross-sectional view of a stabilizer in an inoperative position and FIG. 9B shows a cross-sectional view of a stabilizer in an operative position, according to various embodiments of the disclosure.
Figure 9B:
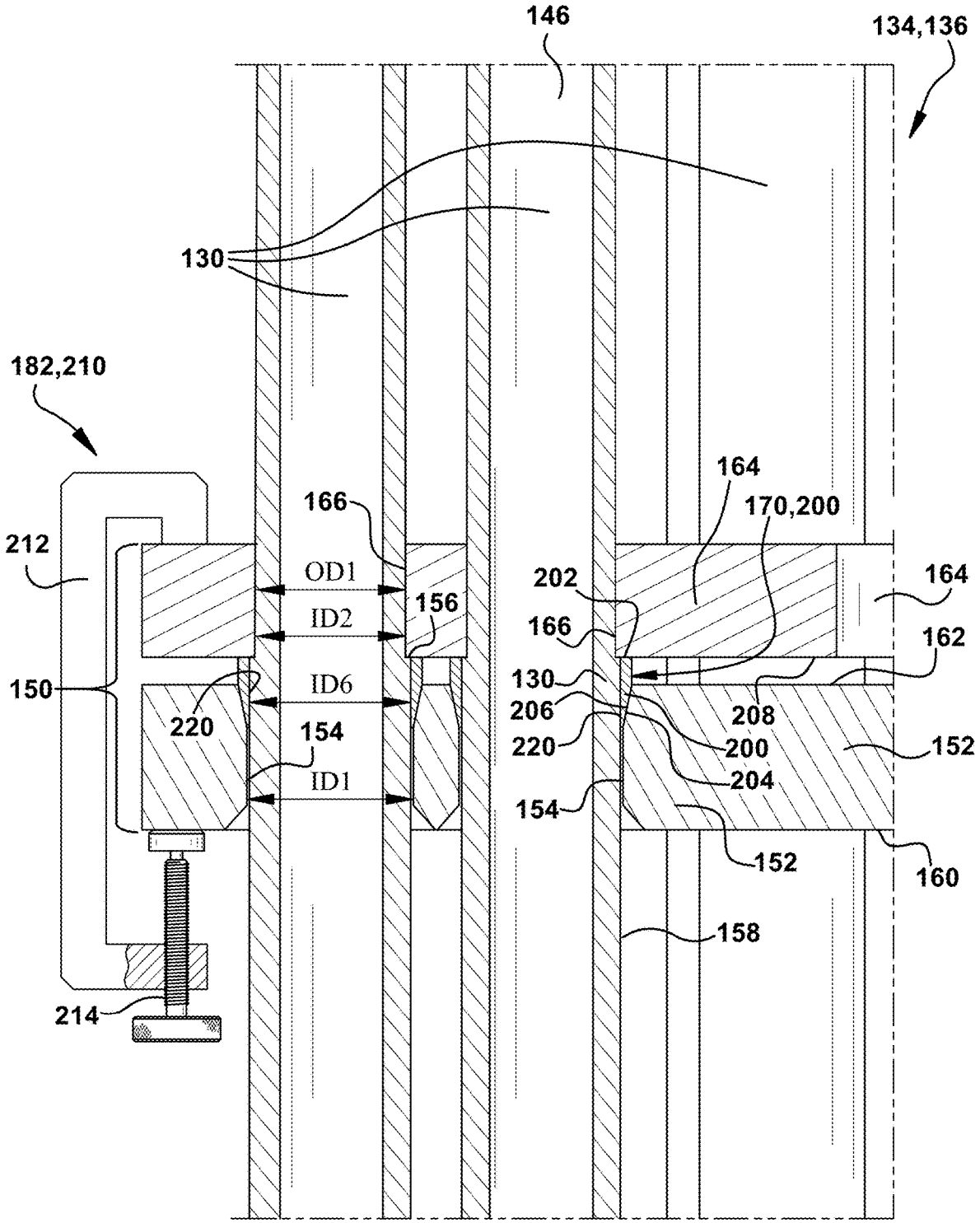
Figure 9C:
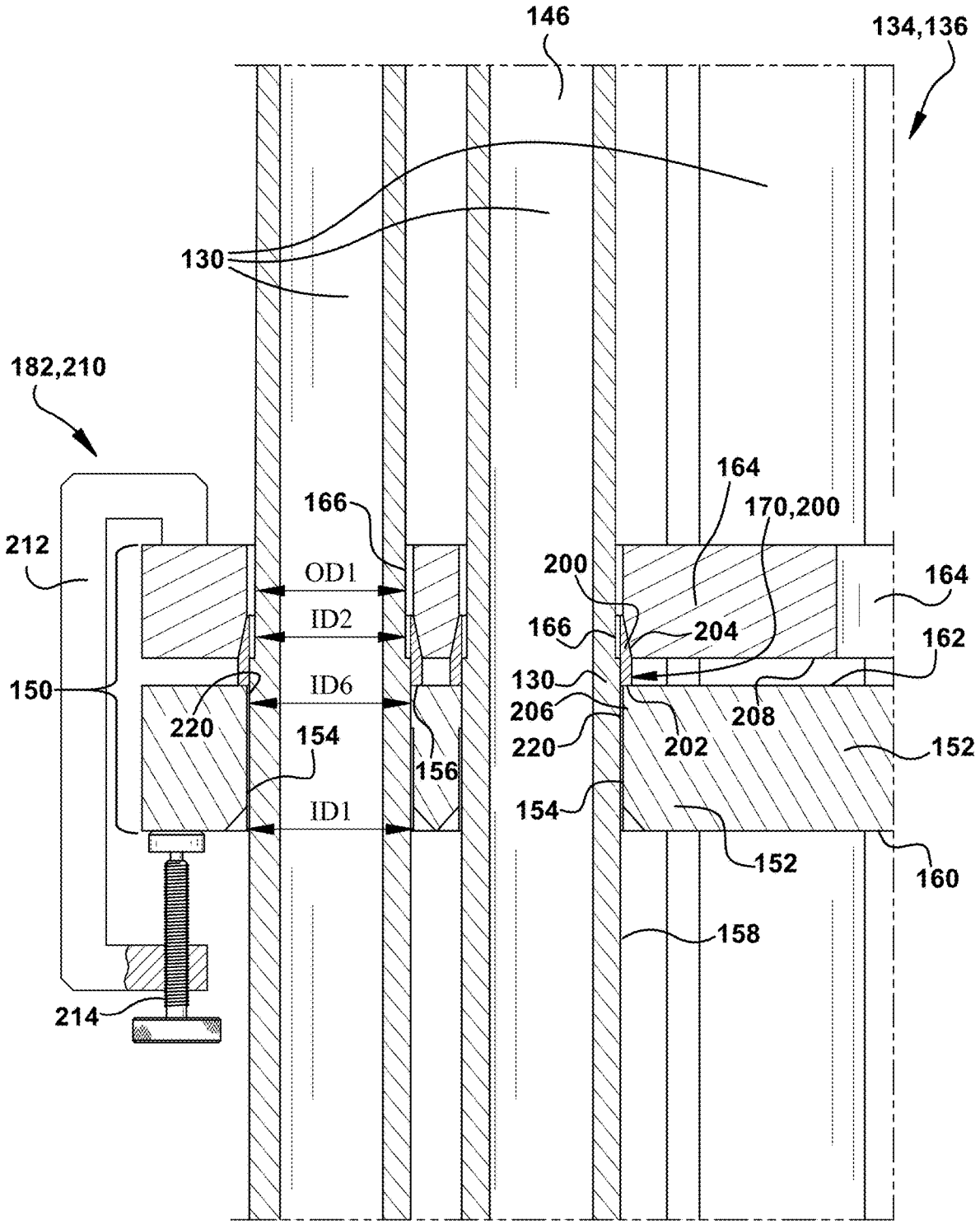
FIG. 9C shows a cross-sectional view of a stabilizer in an inoperative position and FIG. 9D shows a cross-sectional view of a stabilizer in an operative position, according to additional embodiments of the disclosure.
Figure 9D:
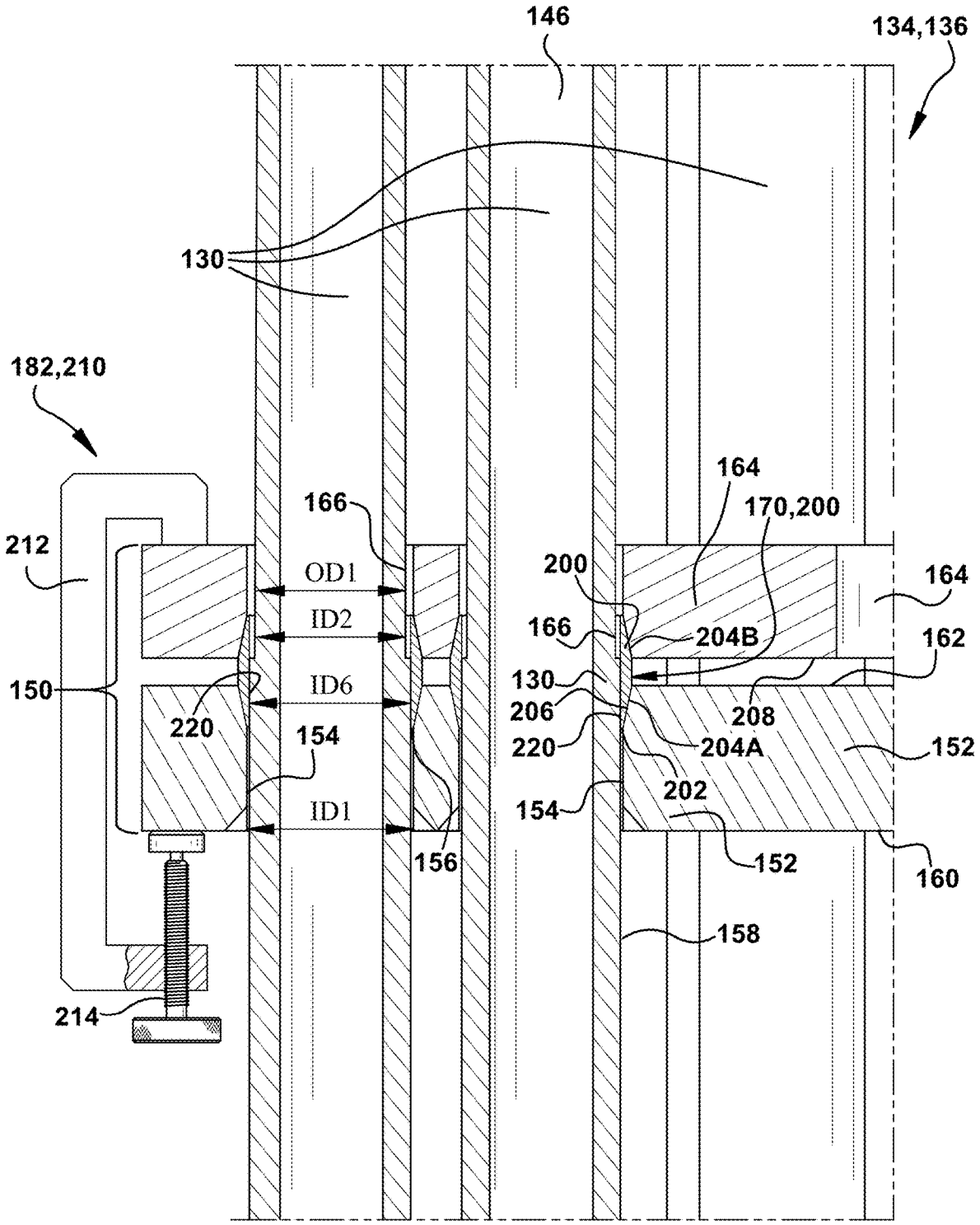
Figure 10A:
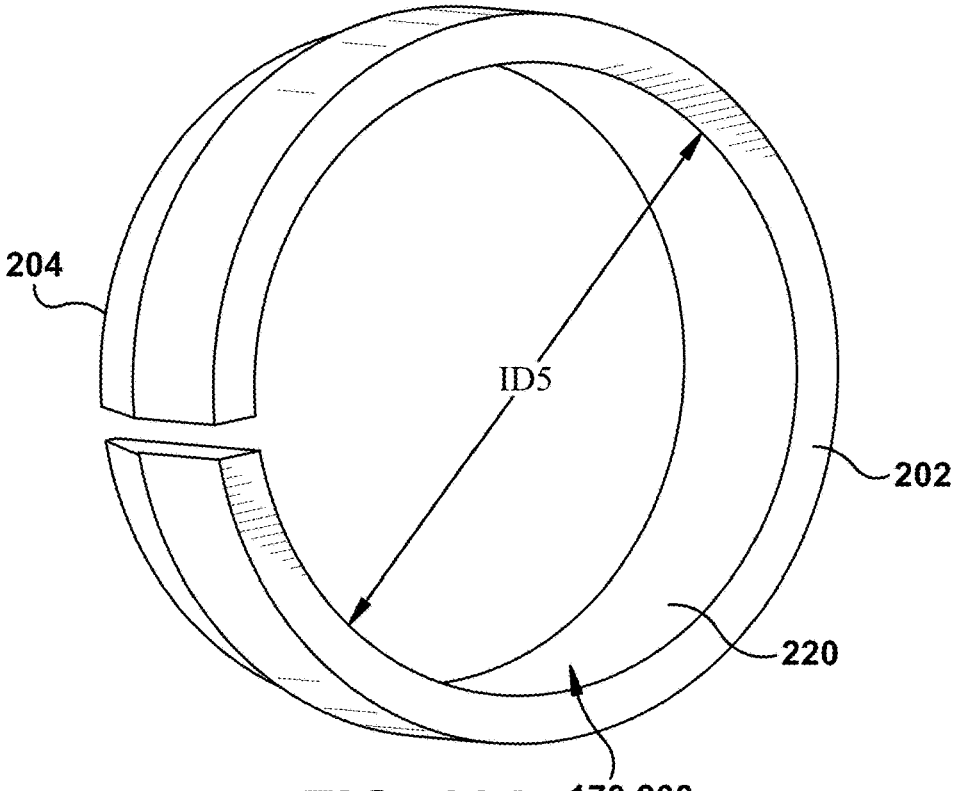
FIGS. 10A-B show perspective views of a tube engagement element in the form of a collet, according to various embodiments of the disclosure.
Figure 10B:
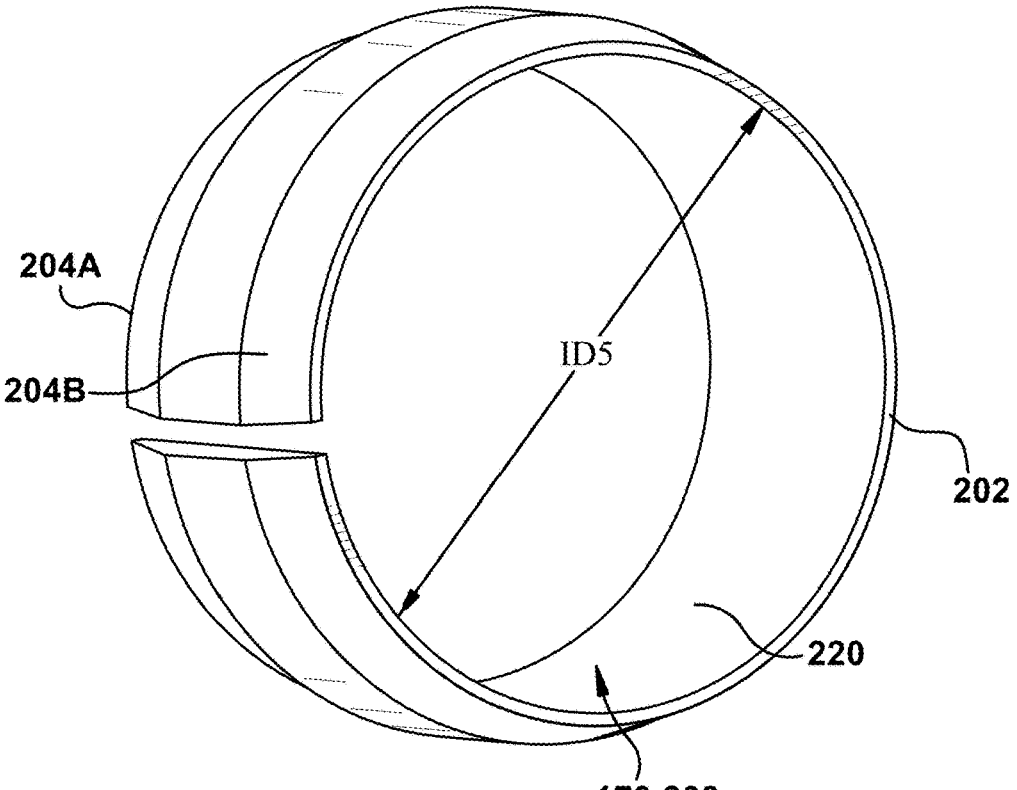

FIGS. 9A-D and 10A-B show stabilizer 150 according to other embodiments of the disclosure FIG. 9A shows a cross-sectional view of stabilizer 150 in an inoperative position, and FIG. 9B shows a cross-sectional view of stabilizer 150 in an operative position, according to other embodiments of the disclosure. FIGS. 9C and 9D show cross-sectional views of stabilizer 150 in an inoperative position and an operative position, respectively, according to additional embodiments of the disclosure. FIGS. 10A-B show perspective views of a tube engagement element 170, according to other embodiments. In FIGS. 9A-9D, tube engagement element 170 may include a collet 200 positioned around each mixing tube 130. As shown in FIGS. 9A-D and 10A-B, each collet 200 may include any known or later developed segmented band or sleeve that can be tightened to grip a respective mixing tube 130. Each collet 200 can be made of any now known or later developed spring steel or similar functioning metal or metal alloy. Each collet 200 includes at least one angled end 204 configured to engage an angled inner portion 206 of an opening, e.g., 154 and/or 166, in at least one of first member 152 and second member 164. In certain embodiments, as shown in FIGS. 9A-B and 10A, each collet 200 may include a first end 202 configured to engage one of first member 152 (FIG. 9B) or second member 164 (FIGS. 9A-B), i.e., on an outer planar surface thereof, and a (single) angled second end 204 configured to engage the other of first member 152 (FIG. 9A-B) or second member 164 (FIG. 9C) in a mating angled inner portion 206 of an opening 166, 154 thereof. In the arrangement shown in FIGS. 9A-B, each first opening 154 in first member 152 may include an angled inner portion 206 configured to engage with angled second end 204 of a respective collet 200. More particularly, the angled inner portion 206 is configured to engage angled second end 204 of collet 200 such that the respective collet 200 engages against outer surface 158 of a respective mixing tube 130 as linear actuator 182 forces second member 164, the respective collet 200 and first member 152 together. In FIGS. 9A-B, non-angled, first end 202 engages with an outer surface of opposing member 164. As shown in FIG. 9C, the arrangement may be reversed (i.e., flipped) with the angled inner portion 206 in opening 166 of second member 154 and non-angled first end 202 engaging an outer surface of first member 152. That is, as shown in FIG. 9C, opening 166 in second member 164 includes an angled inner portion 206 configured to engage with (single) angled end 204 of a respective collet 200, and non-angled, first end 202 of collet 200 may engage with first member 152. In another arrangement, as shown in FIG. 10B, collet 200 may include two angled ends 204A and 204B. In this case, as shown in FIG. 9D, opening 154 in first member 152 and opening 166 in second member 164 may both include angled inner portions 206 for engaging angled second ends 204A, 204B of collet 200. While particular forms of collet 200 have been illustrated, it will be recognized that collets 200 can take a variety of different shapes and configurations for use in stabilizer 150.

As noted previously relative to FIG. 5, and as also shown in FIGS. 9A-B, in certain embodiments, mixing tubes 130 may each optionally include shoulder step 156 on outer surface 158 thereof. As noted relative to FIG. 5, shoulder step 156 is optional and may not be present in all instances of mixing tubes 130. In the FIGS. 9A-B embodiments, where shoulder step 156 is provided, shoulder step 156 may have outer diameter OD2 slightly larger than inner diameter ID2 of second openings 166 in second member 164, e.g., approximately 0.1 cm (~0.04 in). However, inner diameter ID1 of first openings 154 in first member 152 are slightly larger than outer diameter OD2 of shoulder step 156, e.g., approximately 0.1 cm (~0.04 in.). Hence, first openings 154 in first member 152 can pass over a respective shoulder step 156 because inner diameter ID1 of first openings 154 is larger than an outer diameter OD1 of shoulder step 156. In contrast, second openings 166 in second member 164 axially engage respective shoulder steps 156. More particularly, shoulder steps 156 in mixing tubes 130 engage with an axial surface 208 of second member 164 adjacent second openings 166 to axially position second member 164 along mixing tubes 130, i.e., at shoulder steps 156. Shoulder steps 156 may be positioned at any desired axial position on mixing tubes 130 to ensure tube engagement element 170 of stabilizer 150, e.g., collets 200, has a consistent outer diameter OD2 (on shoulder step 156) to engage mixing tubes 130 for stabilization thereof. More particularly, shoulder steps 156 may be advantageous where tube engagement element 170 includes collets 200 to ensures proper mating between collets 200 and second member 164. It is noted, however, shoulder steps 156 may not be necessary in all cases, and may be omitted. Further, while shoulder step 156 is only labeled in the FIGS. 9A-B embodiments, it may also be used in the FIGS. 9C-D embodiments, e.g., to engage a mating step within the inner diameter of collet 200.

In FIGS. 9A-D, linear actuator 182 is shown as a C-clamp 210. C-clamp 210 can include, for example, a C-shaped body 212 with a threaded clamp element 214 threadedly connected through one arm of C-shaped body 212. It is emphasized that any form of linear actuator 182 described herein can be used for stabilizer 150.

In the inoperative position, as shown in FIG. 9A, first member 152 and second member 164 are sufficiently separated so they do not compress tube engagement element 170, i.e., collets 200 are in a generally undeformed state. In this position, tube engagement element 170 is disengaged, i.e., not grasping in a manner to prevent movement, from outer surfaces 158 of mixing tubes 130 and can slide over mixing tubes 130. Accordingly, in the inoperative position, stabilizer 150 including first member 152, second member 164 and tube engagement element 170 can be installed and/or uninstalled from a particular fuel nozzle segment 134, 136. Where shoulder steps 156 are provided, as shown in FIGS. 9A-B, they position second member 164 at that axial location of mixing tubes 130 during installation of stabilizer 150. Where shoulder steps 156 are not provided, second member 164 (and first member 152) can be positioned in any desired axial location of mixing tubes 130 and may be held in that axial location, as will be described herein, when stabilizer 150 is operative.

In the operative position, as shown in FIGS. 9B-D, linear actuator 182 moves first member 152 and second member 164 closer together (than in the inoperative position in FIG. 9A). As linear actuator 182 forces second member 164 and first member 152 together, they compress collets 200 causing an inner surface 220 of each collet 200 to engage with outer surface 158 of a respective mixing tube 130 to stabilize mixing tubes 130. More particularly, first member 152 and second member 164 compress collets 200, which reduces inner diameter ID5 (FIGS. 9A, 10A-B) of collets 200 to inner diameter ID6 (e.g., FIG. 9B). In the operative position, each collet 200 may have an inner diameter ID6 sized to engage outer surface 158, i.e., outer diameter OD1, of mixing tubes 130. That is, each collet 200 grasps or grips a respective mixing tube 130. Hence, an outer diameter OD1 of mixing tubes 130 and inner diameter ID6 of collets 200, in the operative position, are the same or nearly the same, e.g., within a margin of error such as a measurement error. Note, the parts are arranged so that an inner diameter ID6 engages but does not damage mixing tubes 130. In the operative position, collets 200 hold mixing tubes 130 against vibration and/or deformation, stabilizing mixing tubes 130. The FIGS. 9C and 9D embodiments work in a similar fashion. Once repairs are complete on fuel nozzle segments 134, 136 and/or mixing tubes 130, linear actuator 182 can be released to place stabilizer 150 in the inoperative position so it can be removed from mixing tubes 130.

Figure 11A:
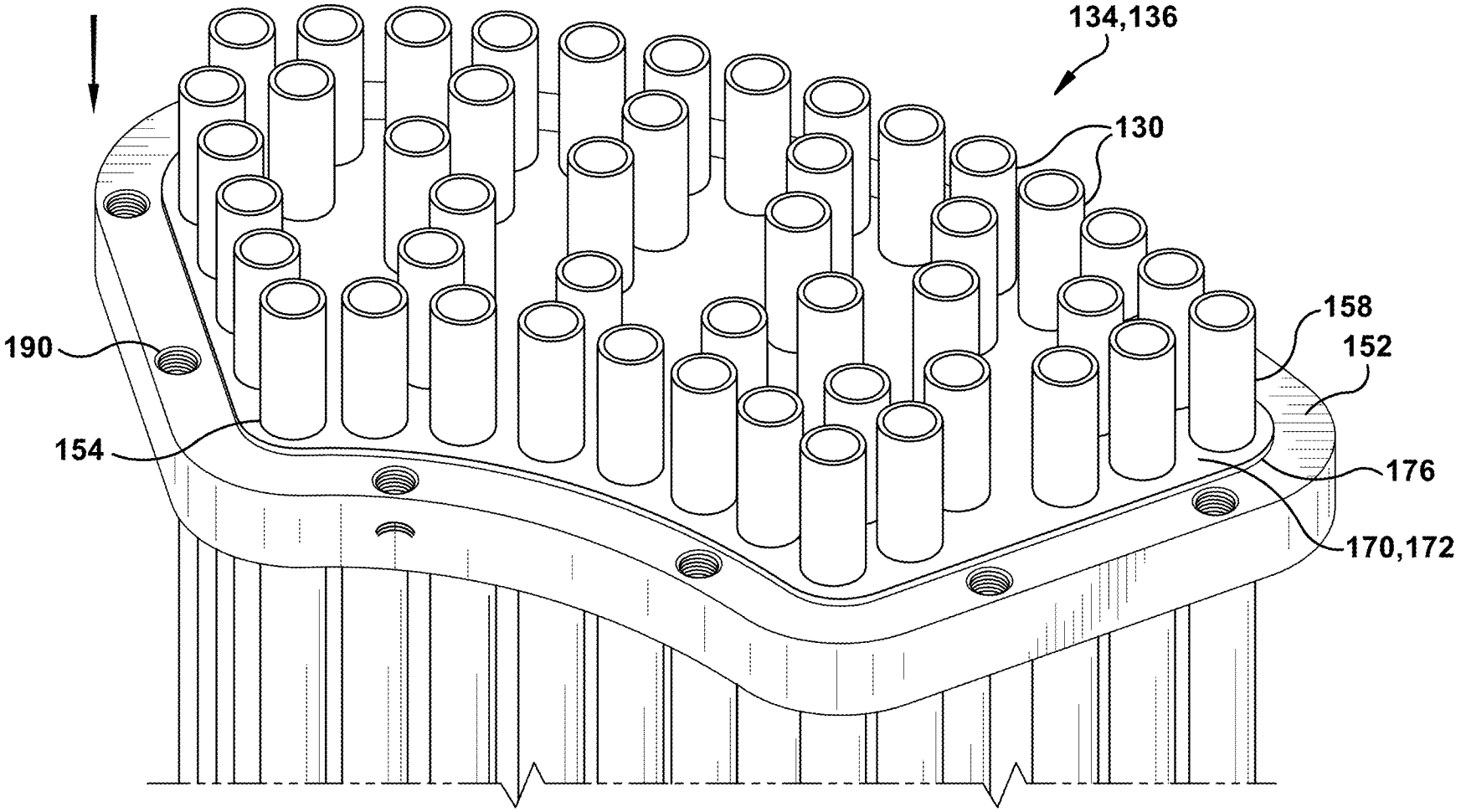
FIGS. 11A-C show perspective views of some steps of a method, according to embodiments of the disclosure.
Figure 11B:
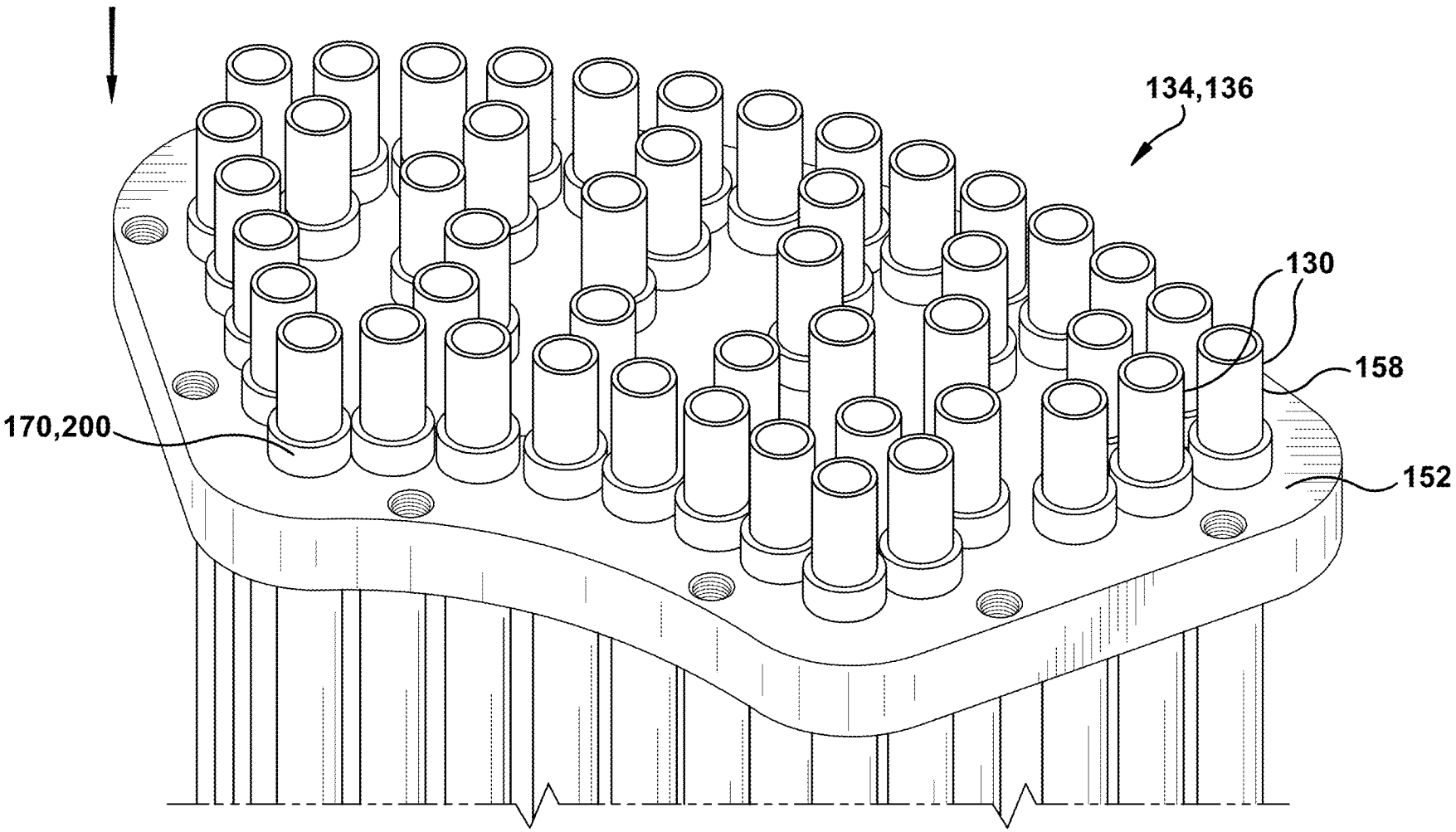
Figure 11C:
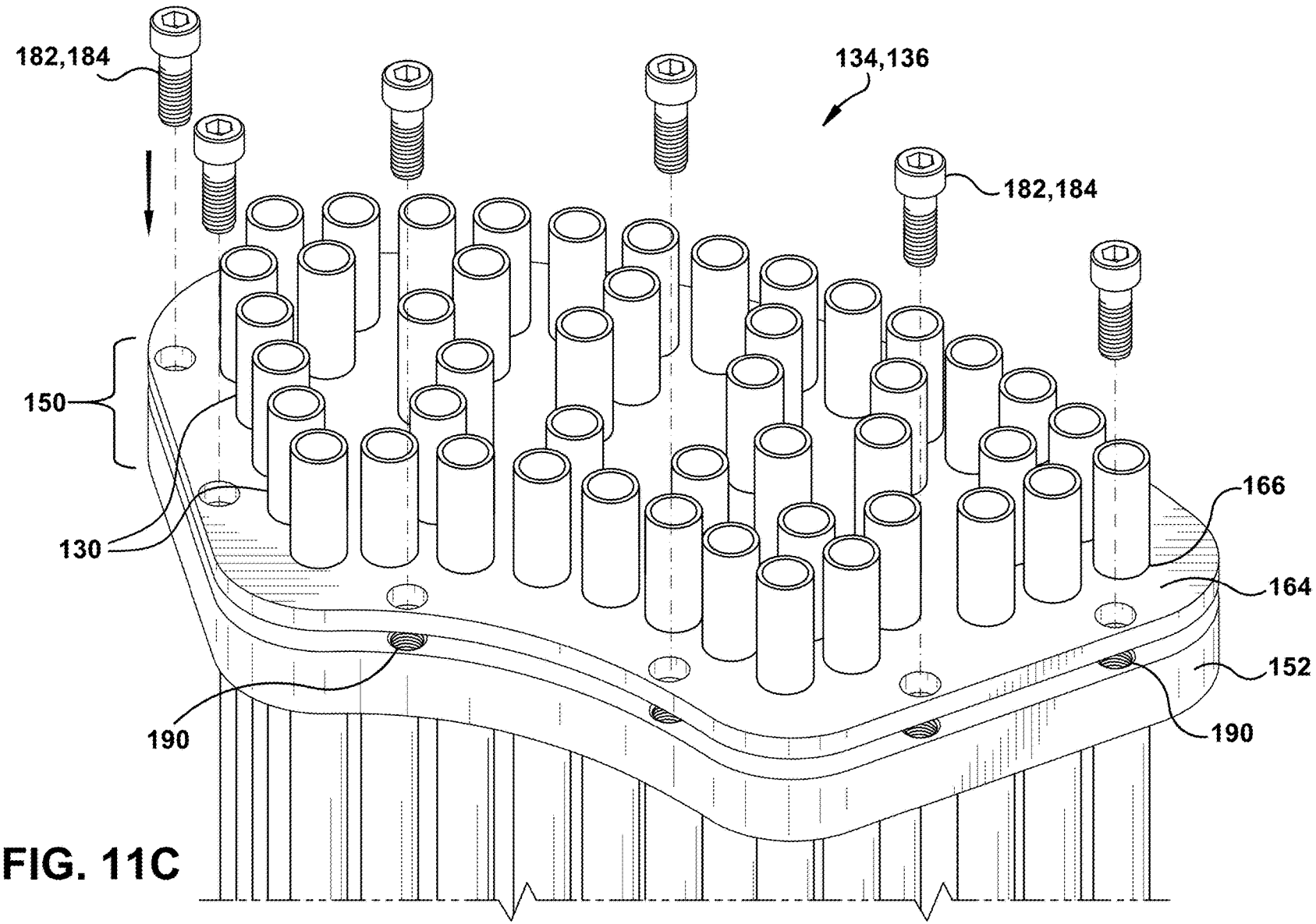

Embodiments of the disclosure also includes a method for stabilizing mixing tubes 130 of micromixer 120 (FIG. 2). FIGS. 11A-C show perspective views of steps of the method. The method may include, as shown in FIGS. 11A and 11B, positioning first member 152 including first openings 154 defined therein over mixing tubes 130. FIG. 11A shows positioning tube engagement element 170 relative to first member 152 in the form of elastomeric member 172. In this version, tube engagement element 170 may be positioned as part of first member 152, e.g., by being positioned in recess 176 therein. FIG. 11B shows positioning tube engagement element 170 relative to first member 152 in the form of collets 200. In this version, tube engagement element 170 may be positioned by positioning a collet 200 around each mixing tube 130. Regardless of form, as described herein, tube engagement element 170 may selectively engages outer surface 158 of each mixing tube 130. FIG. 11C shows positioning second member 164 including second openings 166 defined therein over mixing tubes 130. First openings 154 and second openings 166 may be aligned. As previously described, FIGS. 7B and 9B show moving second member 164 and first member 152 together to force tube engagement element 170 therebetween to engage with outer surface 158 of mixing tubes 130 to stabilize mixing tubes 130. Linear actuator 182 may be activated in any appropriate manner to move second member 164 and first member 152 closer together to force tube engagement element 170 therebetween to engage with outer surface 158 of mixing tubes 130, e.g., turning threaded fasteners 184 (FIG. 7A-B) or threaded clamp element 214 relative to C-shaped body 212 (FIG. 9A-B), or other activation. Once repairs are complete on fuel nozzle segments 134, 136 and/or mixing tubes 130, linear actuator 182 can be released to place stabilizer 150 in the inoperative position so it can be removed from mixing tubes 130.

Embodiments of the disclosure provide various technical and commercial advantages, examples of which are discussed herein. As noted, the stabilizer engages each mixing tube and holds them against vibration and/or deformation during, for example, a repair operation in which ends of damaged mixing tubes are removed and replaced. The stabilizer also limits safety and/or environmental concerns of using a removable vibration damping material, such as wax.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" or "about," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application of the technology and to enable others of ordinary skill in the art to understand the disclosure for contemplating various modifications to the present embodiments, which may be suited to the particular use contemplated.

What is claimed is:

1. A stabilizer for a plurality of mixing tubes of a micromixer, the stabilizer comprising:

a first member including a plurality of first openings defined therein, each first opening configured to receive a respective one of the plurality of mixing tubes;

a second member including a plurality of second openings defined therein, each second opening configured to receive a respective one of the plurality of mixing tubes;

a tube engagement element positioned between the first member and the second member and configured to selectively engage an outer surface of the plurality of mixing tubes; and a linear actuator configured to selectively move the second member and the first member together to engage the tube engagement element therebetween with an outer surface of the plurality of mixing tubes to stabilize the plurality of mixing tubes.

2. The stabilizer of claim 1, wherein the tube engagement element includes an elastomeric member including a plurality of third openings defined therein, each third opening configured to receive a respective one of the plurality of mixing tubes therein, wherein the linear actuator forces the second member and the first member together to compress the elastomeric member causing an inner surface of each third opening to engage with the outer surface of a respective one of the mixing tubes to stabilize the plurality of mixing tubes.

3. The stabilizer of claim 2, wherein the first member includes a recess defined therein in which the elastomeric member is positioned, the recess configured to restrain lateral expansion of the elastomeric member as the linear actuator forces the second member and the first member together to compress the elastomeric member.

4. The stabilizer of claim 3, wherein the second member has a projection configured to slidingly fit within the recess to compress the elastomeric member as the linear actuator forces the second member and the first member together.

5. The stabilizer of claim 2, wherein the plurality of mixing tubes each include a shoulder step in an outer surface thereof, wherein the plurality of first openings in the first member are configured to axially engage the respective shoulder step.

6. The stabilizer of claim 1, wherein the tube engagement element includes a collet positioned around each of the plurality of mixing tubes, wherein each collet includes at least one angled end configured to engage an angled inner portion of a respective one of the first openings or the second openings in at least one of the first member and the second member.

7. The stabilizer of claim 6, wherein each first opening in the first member includes the angled inner portion configured to engage with the at least one angled end of a respective one of the collets to force the respective collet against the outer surface of a respective one of the mixing tubes as the linear actuator forces the second member, the respective collet and the first member together.

8. The stabilizer of claim 6, wherein the plurality of mixing tubes each include a shoulder step in an outer surface thereof, wherein the plurality of first openings in the first member are configured to pass over a respective shoulder step and the plurality of second openings in the second member are configured to axially engage the respective shoulder step.

9. The stabilizer of claim 1, wherein the linear actuator includes at least one threaded fastener, each threaded fastener configured to extend through and engage an outer surface of a fastener opening in one of the second member and the first member and threadedly couple into a mating threaded opening in the other one of the second member and the first member.

10. A stabilizer for a plurality of mixing tubes of a micromixer, the stabilizer comprising:

a first member including a plurality of first openings defined therein, each first opening configured to receive a respective one of the plurality of mixing tubes;

a second member including a plurality of second openings defined therein, each second opening configured to receive a respective one of the plurality of mixing tubes;

a tube engagement element positioned between the first member and the second member and configured to selectively engage an outer surface of at least one of the plurality of mixing tubes, wherein the tube engagement element includes one of:

a) an elastomeric member including a plurality of third openings defined therein, each third opening configured to receive a respective one of the plurality of mixing tubes therein, or b) a collet positioned around each of the plurality of mixing tubes; and a linear actuator configured to selectively move the second member and the first member between an operative position in which the tube engagement element is forced to engage with an outer surface of the plurality of mixing tubes to stabilize the plurality of mixing tubes and an inoperative position in which the tube engagement element is disengaged with the outer surface of the plurality of mixing tubes.

11. The stabilizer of claim 10, where the tube engagement element includes the elastomeric member, and the linear actuator forces the second member and the first member together to compress the elastomeric member causing an inner surface of each third opening to engage with the outer surface of a respective one of the mixing tubes to stabilize the plurality of mixing tubes.

12. The stabilizer of claim 11, wherein the first member includes a recess defined therein in which the elastomeric member is positioned, the recess configured to restrain lateral expansion of the elastomeric member as the linear actuator forces the second member and the first member together to compress the elastomeric member.

13. The stabilizer of claim 12, wherein the second member has a projection configured to slidingly fit within the recess to compress the elastomeric member as the linear actuator forces the second member and the first member together.

14. The stabilizer of claim 11, wherein the plurality of mixing tubes each include a shoulder step in an outer surface thereof, wherein the plurality of first openings in the first member are configured to axially engage the respective shoulder step.

15. The stabilizer of claim 10, wherein each collet includes at least one angled end configured to engage an angled inner portion of a respective one of the first openings or the second openings in at least one of the first member and the second member, wherein the linear actuator forces the second member and the first member together to force an inner surface of each collet to engage with the outer surface of a respective one of the mixing tubes to stabilize the plurality of mixing tubes.

16. The stabilizer of claim 15, wherein each first opening in the first member includes the angled inner portion configured to engage with the at least one angled end of a respective one of the collets to force the respective collet against the outer surface of a respective one of the mixing tubes as the linear actuator forces the second member, the respective collet and the first member together.

17. The stabilizer of claim 15, wherein the plurality of mixing tubes each include a shoulder step in an outer surface thereof, wherein the plurality of first openings in the first member are configured to pass over a respective one of the shoulder steps and the plurality of second openings in the second member are configured to axially engage the respective shoulder step.

18. The stabilizer of claim 10, wherein the linear actuator includes at least one threaded fastener, each threaded fastener configured to extend through and engage an outer surface of a fastener opening in one of the second member and the first member and threadedly couple into a mating threaded opening in the other one of the second member and the first member.

19. A method for stabilizing a plurality of mixing tubes of a micromixer, the method comprising:

positioning a first member including a plurality of first openings defined therein over the plurality of mixing tubes, each first opening configured to receive a respective one of the plurality of mixing tubes;

positioning a tube engagement element relative to the first member, the tube engagement element configured to selectively engage an outer surface of each of the plurality of mixing tubes;

positioning a second member including a plurality of second openings defined therein over the plurality of mixing tubes, each second opening configured to receive a respective one of the plurality of mixing tubes; and moving the second member and the first member together using a linear actuator to force the tube engagement element therebetween to engage with an outer surface of the plurality of mixing tubes to stabilize the plurality of mixing tubes.

20. The method of claim 19, wherein the tube engagement element includes one of:

a) an elastomeric member including a plurality of third openings defined therein, each third opening configured to receive a respective one of the plurality of mixing tubes therein, or b) a collet positioned around each of the plurality of mixing tubes.

* * * * *